US008122873B2

(12) United States Patent
Furukawa et al.

(10) Patent No.: US 8,122,873 B2
(45) Date of Patent: Feb. 28, 2012

(54) EXHAUST GAS RECIRCULATION SYSTEM

(75) Inventors: Akira Furukawa, Kariya (JP); Osamu Shimane, Kariya (JP); Yuichiro Moritani, Kariya (JP); Shinsuke Miyazaki, Chiryu (JP)

(73) Assignee: Denso Corporation, Kariya (JP)

( * ) Notice: Subject to any disclaimer, the term of this patent is extended or adjusted under 35 U.S.C. 154(b) by 328 days.

(21) Appl. No.: 12/575,605

(22) Filed: Oct. 8, 2009

(65) Prior Publication Data

US 2010/0089370 A1 Apr. 15, 2010

(30) Foreign Application Priority Data

Oct. 10, 2008 (JP) ..... 2008-264550

(51) Int. Cl.
*F02B 47/08* (2006.01)
*F02B 47/10* (2006.01)

(52) U.S. Cl. ..... 123/568.24; 123/568.12

(58) Field of Classification Search ..... 123/568.24, 123/568.11, 568.12, 568.15, 568.17; 701/108; 60/605.2

See application file for complete search history.

(56) References Cited

U.S. PATENT DOCUMENTS

| | | | | |
|---|---|---|---|---|
| 4,257,371 | A * | 3/1981 | Ishida | 123/198 F |
| 5,562,085 | A | 10/1996 | Kosuda et al. | |
| 2007/0017489 | A1 | 1/2007 | Kuroki et al. | |
| 2008/0184974 | A1 | 8/2008 | Kobayashi et al. | |

FOREIGN PATENT DOCUMENTS

| | | |
|---|---|---|
| JP | 11-351072 | 12/1999 |
| JP | 2003-314377 | 11/2003 |
| JP | 2007-132305 | 5/2007 |
| JP | 2007-155029 | 6/2007 |

OTHER PUBLICATIONS

Japanese Office Action dated Aug. 31, 2010 issued in corresponding Japanese Application No. 2008-264550 with English Translation.

* cited by examiner

*Primary Examiner* — Mahmoud Gimie
(74) *Attorney, Agent, or Firm* — Nixon & Vanderhye PC

(57) ABSTRACT

An actuator includes an electric motor and a drive force transmitting mechanism. The drive force transmitting mechanism includes a rotary gear and a rotary cam. The rotary gear transmits a drive force of the electric motor to an EGR valve to drive the same. The rotary cam transmits the drive force of the electric motor to a mode change valve to drive the same. The rotary cam is releasably linkable to the rotary gear to receive the drive force of the electric motor through the rotary gear.

9 Claims, 12 Drawing Sheets

EXHAUST GAS RECIRCULATION SYSTEM

CROSS REFERENCE TO RELATED APPLICATION

This application is based on and incorporates herein by reference Japanese Patent Application No. 2008-264550 filed on Oct. 10, 2008.

BACKGROUND OF THE INVENTION

1. Field of the Invention

The present invention relates to an exhaust gas recirculation system, which recirculates exhaust gas of an internal combustion engine from an exhaust passage to an intake passage of the internal combustion engine.

2. Description of Related Art

The exhaust gas recirculation system (EGR system), which recirculates the exhaust gas of the internal combustion engine from the exhaust passage to the intake passage, is known. In this EGR system, a water-cooled exhaust gas cooler (EGR cooler), which uses coolant to cool the exhaust gas, is provided in an exhaust gas recirculation pipe (EGR pipe), through which the exhaust gas (EGR gas) is recirculated from the exhaust passage to the intake passage. With this EGR system, the combustion temperature of the engine can be advantageously reduced to reduce the amount of noxious components (e.g., NOx) contained in the exhaust gas without deteriorating the output power of the engine.

Furthermore, in the EGR system having the EGR cooler, the EGR gas is recirculated from the exhaust passage to the intake passage while bypassing the EGR cooler when the temperature of the coolant is low, for example, at the time of engine start or during the winter season. In the EGR system having the EGR cooler, a bypass passage is formed in an interior of a housing having a cooler installation surface, to which the EGR cooler is installed. The bypass passage recirculates the EGR gas, which is supplied into a valve receiving chamber of the housing, to the intake passage while bypassing the EGR cooler. In the valve receiving chamber, there is provided a bypass change valve assembly, in which a bypass change valve is rotatably provided to open or close the bypass passage.

With reference to FIGS. 16 and 17, in a previously known EGR cooler system (see, for example, Japanese Unexamined Patent Publication No. 2007-132305A), an EGR valve module, which has an EGR valve 102 and a mode change valve 103, is placed in a housing 101 having a cooler installation surface, to which an EGR cooler (not shown) is installed. The EGR valve 102 variably controls the flow quantity of the EGR gas, which flows through the EGR gas passage. The mode change valve 103 changes the flow of the EGR gas between a cooler mode (cooled mode) for conducting the EGR gas through the EGR cooler and a bypass mode (hot bode) for conducing the EGR gas through a bypass passage 13 that bypasses the EGR cooler.

The EGR valve 102 is driven by an electric motor provided in an actuator main body 105 through a rotatable shaft 104, which supports the EGR valve 102.

The actuator main body 105 is a housing, an opening of which is closed with the sensor cover 49. The actuator main body 105 receives the electric motor (e.g., a DC motor) and a drive force transmission mechanism (e.g., a speed reducing gear mechanism). The electric motor generates a drive force upon receiving an electric power. The drive force transmission mechanism transmits the drive force of the electric motor to the rotatable shaft 104. That is, the actuator main body 105 forms an electric actuator, which includes the electric motor and the drive force transmission mechanism.

The mode change valve 103 is driven by a negative pressure driven actuator (not shown) through a rotatable shaft 106, which supports the mode change valve 103. The mode change valve 103 changes the operational mode between the cooler mode (FIG. 16) and the bypass mode (FIG. 17). In the cooler mode (FIG. 16), first and second EGR gas passages 11, 12, which are communicated with an inlet and an outlet, respectively, of the EGR cooler, are formed in the interior of the housing 101. In the bypass mode (FIG. 17), the bypass passage 13, which bypasses the EGR cooler, is formed in the interior of the housing 101.

The negative pressure driven actuator introduces the negative pressure, which is supplied from an electric vacuum pump, to a negative pressure chamber through a negative pressure control valve, so that a diaphragm is displaced in a plate thickness direction of the diaphragm due to a pressure difference between the negative pressure chamber and an atmospheric pressure chamber, and thereby a rod, which is synchronized with the diaphragm, is axially displaced. When the axial displacement of the rod is transmitted to the rotatable shaft 106 through a link plate, the rotatable shaft 106 is rotated for a predetermined angle. In this way, the valve position of the mode change valve 103 is changed.

In the exhaust gas recirculation system of Japanese Unexamined Patent Publication No. 2007-132305A, the EGR valve 102 and the mode change valve 103 are placed in the housing 101 having the cooler installation surface, to which the EGR cooler is installed to form the EGR valve module. In this instance, the electric actuator, which drives the EGR valve 102, and the negative pressure driven actuator, which drives the mode change valve 103, need to be separately provided. The provision of the two actuators disadvantageously results in an increase in the number of the components, so that the product costs may be disadvantageously increased.

Furthermore, the two actuators are provided to the housing such that the actuators protrude from the outer wall surface of the housing. Therefore, the entire size of the EGR valve module is increased, and thereby the required installation space for installing the EGR valve module on the vehicle is disadvantageously increased.

In view of the above disadvantage, it is conceivable to integrate the actuator, which drives the EGR valve 102, and the actuator, which drives the mode change valve 103, into a single negative pressure driven actuator.

However, the mode change valve 103, which is a two-position valve that changes between the cooler mode and the bypass mode, is disadvantageously synchronized with the actuator, which changes the rotational angle of the EGR valve 102 to continuously change the opening degree of the EGR gas passage. Therefore, it is difficult to satisfy both of the function of the EGR valve 102 and the function of the mode change valve 103.

For instance, even in the case where the mode change valve 103 is synchronized with the EGR valve 102 up to a predetermined location and is then desynchronized from the drive mechanism of the EGR valve 102, it is still difficult to displace the mode change valve 103 out of the range, within which the mode change valve 103 has an influence on the operation of the EGR valve 102. Furthermore, it is difficult to maintain such a position, and it is also difficult to implement the structure, which synchronizes the EGR valve 102 and the mode change valve 103.

The exhaust gas, which is outputted from the combustion chamber of the internal combustion engine, contains fine particulate impurities (exhaust fine particles, particulate matter), such as combustion residues or carbon particles. Therefore, the deposit of the particulate impurities contained in the EGR gas may possibly be adhered or accumulated at the interior of the housing 101 during the operation of the engine.

In the case where the deposit is adhered or accumulated around the EGR valve 102 and the mode change valve 103, when a viscosity of the deposit becomes relatively high upon dropping of the temperature of the deposit after engine stop, the EGR valve 102 and the mode change valve 103 may possibly stick to the passage wall of the housing 101 due to the solidification of the deposit.

Therefore, for example, at the time of the engine start, the EGR valve 102, which sticks to the passage wall surface of the housing 101 due to the solidified deposit that is adhered or accumulated around the EGR valve 102, is driven back-and-forth to rotate the EGR valve 102 about the valve full close position of the EGR valve 102. Furthermore, the mode change valve 103, which sticks to the flow passage wall surface of the housing 101 due to the solidified deposit that is adhered to or accumulated around the mode change valve 103, is driven back-and-forth to rotate the mode change valve 103 about the bypass full close position or the bypass full open position. As discussed above, it is conceivable to implement the method for releasing the sticking of the EGR valve 102 or the mode change valve 103 or the method for pulling and releasing the EGR valve 102 or the mode change valve 103 from the deposit that is adhered or accumulated around the EGR valve 102 or the mode change valve 103.

However, in the case of synchronizing the EGR valve 102 and the mode change valve 103 of Japanese Unexamined Patent Publication No. 2007-132305A through use of the negative pressure driven actuator, the size of the negative pressure driven actuator is disadvantageously increased to effectively implement the releasing of the sticking (pulling and releasing) of the EGR valve 102 and the mode change valve 103 even in the state where the negative pressure, which serves as the drive power source, is the low negative pressure. Therefore, the entire size of the EGR valve module is further increased, and thereby the required installation space for installing the EGR valve module on the vehicle is further increased.

In addition, the deposit can be easily adhered to or accumulated around the valve (the EGR valve 102, the mode change valve 103), which is used in the EGR system, and the deposit can be easily solidified upon decreasing of the temperature. Therefore, it is required to provide the releasing torque or load for releasing the sticking of the EGR valve 102 or the mode change valve 103 from the passage wall surface of the housing 101.

However, when the EGR valve 102 and the mode change valve 103 need to be driven by the drive force of the single actuator installed to the outer wall surface of the housing 101, the size of the actuator becomes disadvantageously large. Therefore, the entire size of the EGR valve module is further increased, and thereby the required installation space for installing the EGR valve module on the vehicle is further increased.

SUMMARY OF THE INVENTION

The present invention addresses the above disadvantage. According to the present invention, there is provided an exhaust gas recirculation system for an internal combustion engine. The exhaust gas recirculation system includes a housing, first and second valves and an actuator. The housing has an interior passage space, through which exhaust gas of the internal combustion engine is recirculated from an exhaust passage to an intake passage of the internal combustion engine. The housing is adapted to join with an exhaust gas cooler that is communicatable with the exhaust passage and the intake passage through the interior passage space of the housing. Each of the first and second valves is received in the housing in a manner that enables opening and closing thereof. The actuator includes an electric motor. When the electric motor receives an electric power, the electric motor generates a drive force, which drives the first and second valves. The first valve forms a flow quantity control valve that controls a flow quantity of the exhaust gas, which passes through the interior passage space of the housing. The second valve forms a mode change vale that changes an operational mode of the exhaust gas recirculation system between a cooled mode and a bypass mode. In the cooler mode, first and second gas passages are formed with aid of the second valve in the interior passage space of the housing. The first gas passage is configured to communicate with an inlet of the exhaust gas cooler and thereby to conduct the exhaust gas supplied from the exhaust passage to the inlet of the exhaust gas cooler, and the second gas passage is configured to communicate with an outlet of the exhaust gas cooler and thereby to conduct the exhaust gas cooled through the exhaust gas cooler. In the bypass mode, a bypass passage is formed with aid of the second valve in the interior passage space of the housing, wherein the bypass passage conducts the exhaust gas supplied from the exhaust passage toward the intake passage while bypassing the exhaust gas cooler. The actuator further includes a drive force transmitting mechanism that has a first rotary member and a second rotary member. The first rotary member transmits the drive force of the electric motor to the first valve to drive the first valve. The second rotary member transmits the drive force of the electric motor to the second valve to drive the second valve. The second rotary member is releasably linkable to the first rotary member to receive the drive force of the electric motor through the first rotary member. The first rotary member includes an engaging element that is rotatable about a rotational axis thereof. The second rotary member includes a cam portion that is engageable with the engaging element of the first rotary member through a predetermined synchronization range, in which movement of the first valve and movement of the second valve are synchronized with each other. The cam portion of the second rotary member is disengaged from the engaging element of the first rotary member when the first valve and the second valve are out of the predetermined synchronization range.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
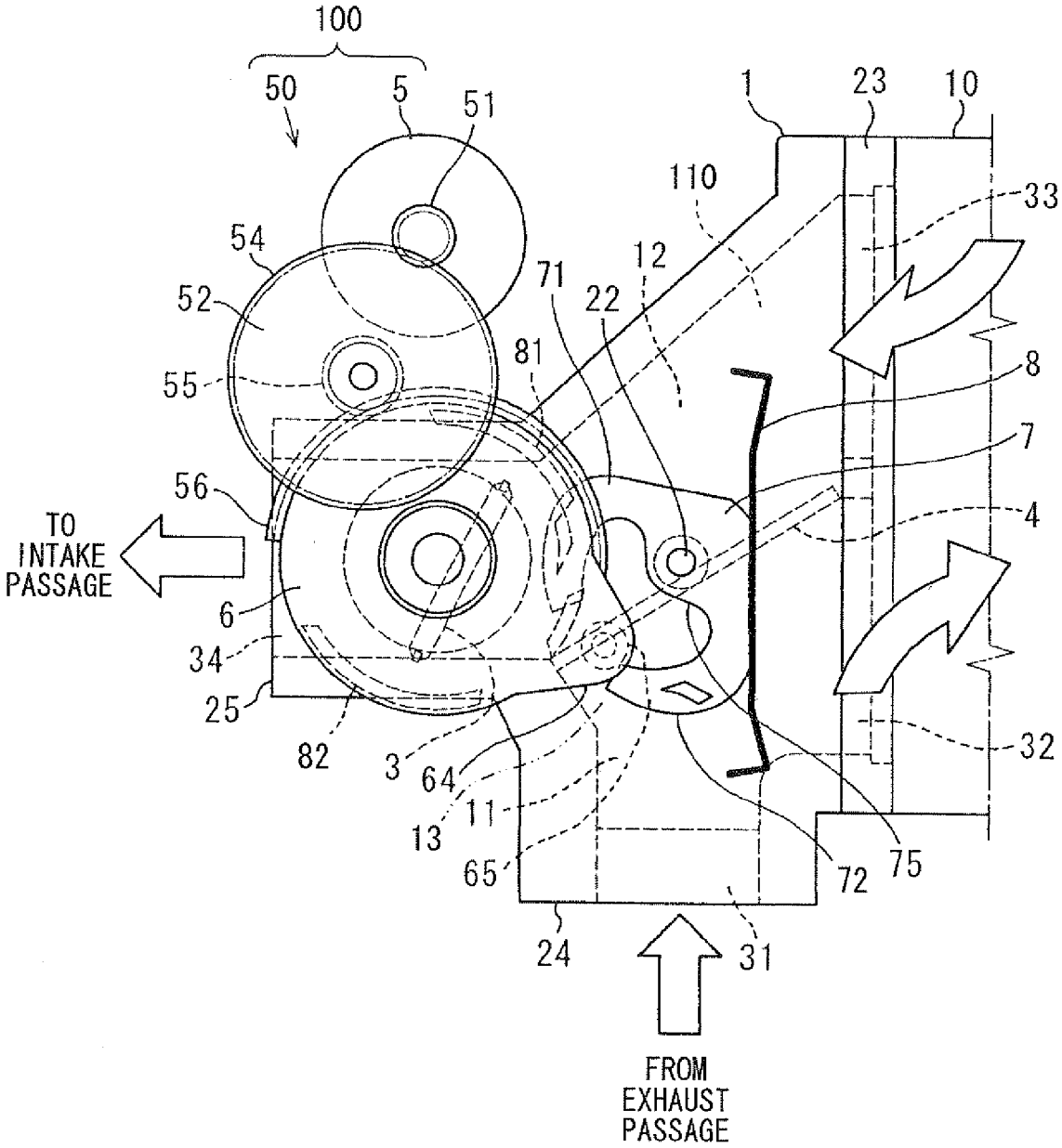
FIG. 1 is a schematic diagram showing an electric actuator according to a first embodiment of the present invention.
Figure 2:
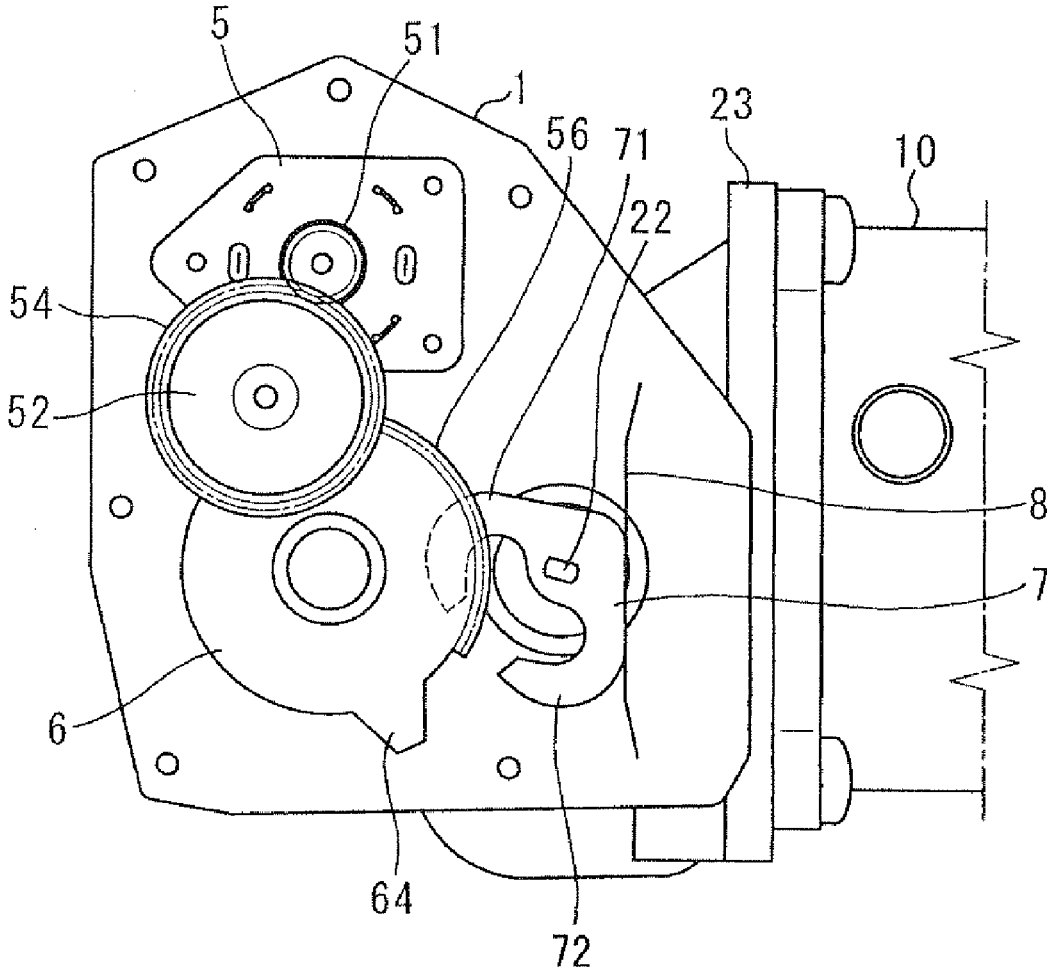
FIG. 2 is a schematic diagram showing the electric actuator according to the first embodiment.
Figure 3:
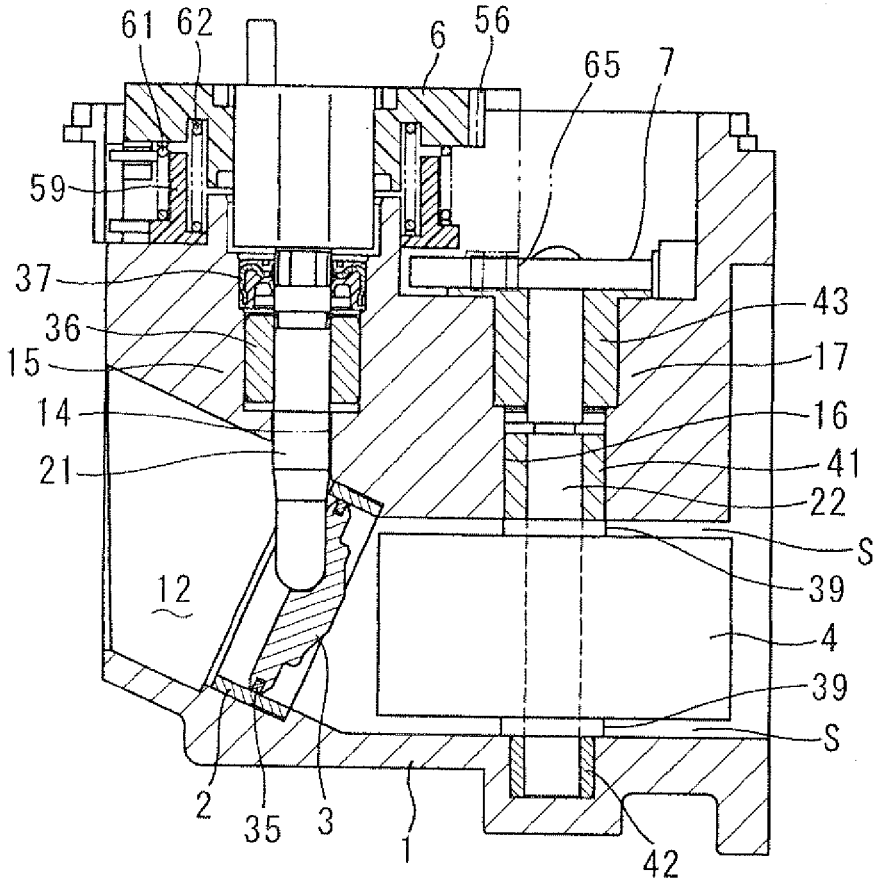
FIG. 3 is a cross-sectional view showing an EGR valve module according to the first embodiment.
Figure 4:
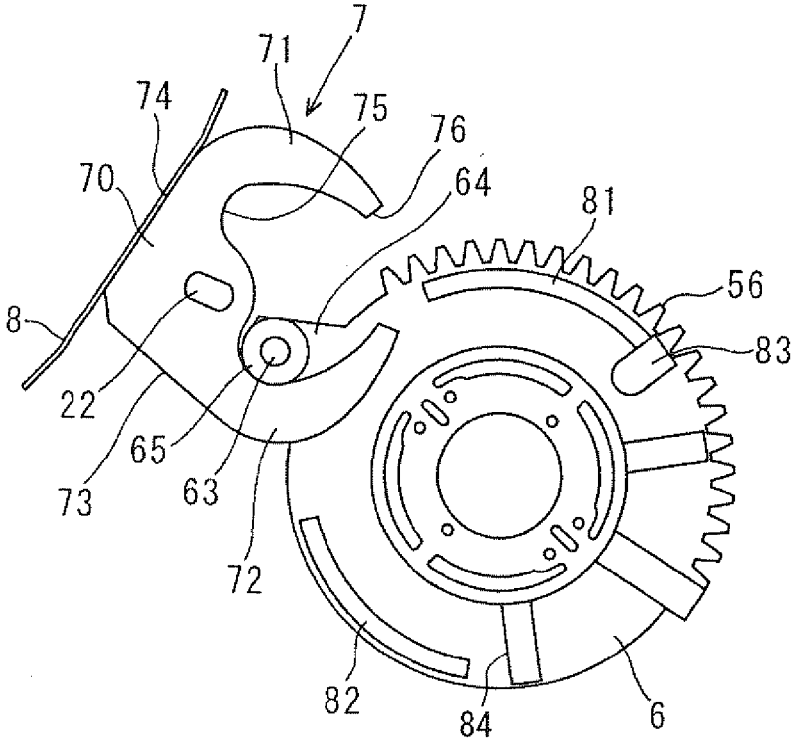
FIG. 4 is a descriptive diagram showing a linked state, in which a rotary cam is linked with a rotary gear, according to the first embodiment.

FIGS. 1 to 13 show a first embodiment of the present invention. Specifically, FIGS. 1 and 2 show an electric actuator. FIG. 3 shows an EGR valve module. FIG. 4 shows a rotary cam (cam plate) linked to a rotary gear.

An exhaust gas recirculation (EGR) system of an internal combustion engine (hereinafter, simply referred to as an engine) according to the present embodiment includes an EGR pipe and an EGR valve module. A portion of exhaust gas of the engine serves as EGR gas and is recirculated to intake ports of cylinders of the engine through the EGR pipe. The EGR valve module is interposed in the EGR pipe. The EGR valve module includes an EGR gas cooler and an EGR gas control apparatus. The EGR gas cooler cools the EGR gas, which is recirculated from the exhaust passage to the intake passage. The EGR gas control apparatus controls the flow quantity and the temperature of the EGR gas, which is recirculated from the exhaust passage to the intake passage.

In this instance, the engine is a direct fuel injection type diesel engine, in which fuel is directly injected into a combustion chamber of each cylinder. The intake port of each cylinder is opened and closed with a corresponding intake valve. The intake passage, which is formed in an engine intake pipe (intake duct), is connected to the intake port of the cylinder. The exhaust port of each cylinder is opened and closed with a corresponding exhaust valve. The exhaust passage, which is formed in an engine exhaust pipe (exhaust duct), is connected to the exhaust port of the cylinder.

A piston, which is connected to the crankshaft of the engine, is slidably received in a cylinder bore of the cylinder.

The EGR valve module includes an exhaust gas flow quantity control valve assembly (EGR gas flow quantity control valve assembly that will be hereinafter referred to as an EGRV assembly) and a mode change control valve assembly, which are integrated together. The EGRV assembly controls the flow quantity of the EGR gas, which flows through an interior passage space defined in a valve housing (hereinafter, referred to as a housing) 1. The mode change control valve assembly changes a subject internal passage in the housing 1. The housing 1 of the EGR valve module is the common housing for both of the EGRV assembly and the mode change control valve assembly.

The housing 1 is configured into a predetermined shape and is made as, for example, a heat-resistant material (e.g., a mold made of iron or cast iron) product, which can withstand the high temperature, or a heat resistant aluminum alloy die-cast product or aluminum alloy cast product.

The housing 1 is inserted into the intermediate location of the EGR pipe and has a hollow portion (valve receiving chamber also referred to as an interior passage space 110) defined therein. The housing 1 has a cylindrical nozzle fitting portion, to which a cylindrical nozzle 2 is fitted. The nozzle 2 is configured into a cylindrical body (or a circular disk-like body) and is made of a heat resistant material, such as a metal material (e.g., stainless steel).

As shown in FIG. 1, first and second EGR gas passages 11, 12 are defined in the interior passage space 110 of the housing 1 during the operation in a cooler mode (cooled mode). Furthermore, a bypass passage 13 is defined in the interior passage space 110 of the housing 1 during the operation in a bypass mode (hot mode). The bypass passage 13 of the present embodiment is similar to that of FIG. 17.

Also, a bearing holding portion (shaft bearing portion) 15, which has a first shaft receiving through hole 14, and a bearing holding portion (shaft bearing portion) 17, which has a second shaft receiving through hole 16, are formed in the housing 1. Details of the housing 1 will be discussed later.

The EGRV assembly is installed to the housing 1, to which an EGR cooler (exhaust gas cooler) 10 is installed. The EGRV assembly includes a first valve (exhaust gas flow quantity control valve, which will be hereinafter referred to as an EGR valve) 3 of a butterfly type and an electric actuator 100. The EGR valve 3 is received in the nozzle 2, which is held by the housing 1, such that the EGR valve 3 opens or closes the first and second EGR gas passages 11, 12 or the bypass passage 13 relative to an intake passage side portion of the interior passage space 110 located on the intake passage side (left side in FIG. 1) of the housing 1. The electric actuator 100 drives the EGR valve 3.

The mode change control valve assembly is installed to the housing 1, which is the common housing for both of the mode change control valve assembly and the EGRV assembly. The mode change control valve assembly includes a second valve of a butterfly type (hereinafter referred to as a mode change valve) 4 and the electric actuator 100, which is the same as the electric actuator 100 of the EGRV assembly, as discussed below. The mode change valve 4 is received in the interior (the valve receiving chamber, i.e., the interior passage space 110) of the housing 1 and is driven by the electric actuator 100 to change the operational mode between the cooled mode and the hot mode. In the cooled mode, the EGR gas flows through the EGR cooler 10. In the hot mode, the EGR gas flows while bypassing the EGR cooler 10. The electric actuator 100 drives the mode change valve 4 and is constructed as the common actuator, which is common to both of the EGR valve 3 and the mode change valve 4.

The EGRV assembly further includes a first rotatable shaft (valve shaft, which will be hereinafter referred to as a first shaft) 21 that supports the EGR valve 3. The mode change control valve assembly further includes a second rotatable shaft (valve shaft, which will be hereinafter referred to as a second shaft) 22 that supports the mode change valve 4.

Details of the EGRV assembly and the mode change control valve assembly will be described later.

In this instance, the electric actuator 100 includes an electric motor 5 and a drive force transmission mechanism 50. The electric motor 5 generates a rotational drive force (drive torque) to drive the first and second valves (the EGR valve 3 and the mode change valve 4) upon energization thereof, i.e., upon receiving electric power. The drive force transmission mechanism 50 transmits the drive torque of the electric motor 5 to the EGR valve 3 and the mode change valve 4.

The drive force transmission mechanism 50 includes a speed reducing gear mechanism, which has first to third gears. One of the first to third gears, which is closest to the EGR valve 3, is referred to as a first rotary member (a first rotary plate, a gear plate or a final speed reducing gear, which will be hereinafter referred to as a rotary gear) 6. The drive force transmission mechanism 50 further includes a second rotary member (a second rotary cam or a cam plate, which will be hereinafter referred to as a rotary cam) 7 and a spring 8. The rotary cam 7 is synchronized with the rotary gear 6. The spring 8 urges the rotary cam 7 toward the rotary gear 6, so that the rotary cam 7 is linkable to the rotary gear 6, i.e., is engageable and disengageable relative to the rotary gear 6. Details of the electric actuator 100 will be described later.

The EGR cooler 10 is an water-cooled exhaust gas cooler that reduces the temperature of the EGR gas equal to or below the desirable exhaust gas temperature by exchanging the heat between the EGR gas and the engine coolant supplied from an water jacket of the engine. The EGR cooler 10 is air-tightly connected to a cooler installation surface of the housing 1.

The EGR cooler 10 includes a rectangular casing and a laminated core (not shown). The rectangular casing has an opening at one axial side of the rectangular casing. The laminated core has a plurality of planar tubes, each of which conducts the EGR gas therethrough. The planar tubes are stacked one after another in a thickness direction thereof. Offset type Inner fins are inserted into each planar tube to increase the heat exchange performance. A U-shaped EGR gas passage, which is formed by connecting two planar passages through a U-shaped portion, is defined in each planar tube.

In the laminated core, coolant passages (not shown) are provided to circulate the engine coolant around the planar tubes.

An inlet pipe and an outlet pipe are connected to the casing of the EGR cooler 10. The engine coolant flows into the coolant passages of the laminated core through the inlet pipe and flows out the coolant passages of the laminated core through the outlet pipe. An inlet side tank chamber and an outlet side tank chamber are defined between an upper wall of the casing and the laminated core and are partitioned by an undepicted partition wall.

A connecting portion, which includes a connecting surface (housing installation surface) that is connected to the cooler installation surface of the housing 1, is formed integrally in a housing side end portion of the casing. An exhaust gas inlet (EGR gas inlet) of the inlet side tank chamber and an exhaust gas outlet (EGR gas outlet) of the outlet side tank chamber are opened in the housing installation surface of the connecting portion.

A flange is integrally formed in the connecting portion of the casing such that the flange outwardly projects from an outer wall surface of the casing.

The EGR cooler 10 is connected to the cooler installation surface of the housing 1 with bolts while the housing installation surface of the connecting portion of the casing and the cooler installation surface of the housing 1 are tightly engaged with each other.

A seal (e.g., a gasket or packing), which limits leakage of the EGR gas to the outside, may be interposed between the housing installation surface of the EGR cooler 10 and the cooler installation surface of the housing 1.

The cooler installation surface, to which the connecting portion (the flange) of the EGR cooler 10 is installed, is formed in the connecting portion (flange 23) of the housing 1.

The housing 1 includes a first connecting portion 24 and a second connecting portion 25. The first connecting portion 24 is configured into a cylindrical form and projects toward the upstream side (exhaust passage side) in the flow direction of the EGR gas. The second connecting portion 25 is configured into a cylindrical form and projects toward the downstream side (intake passage side) in the flow direction of the EGR gas.

The first connecting portion 24 has a first connecting surface on the upstream side of the valve receiving chamber (interior passage space 110) of the housing 1 in the flow direction of the EGR gas. The EGR pipe (or a branching portion of the exhaust duct, particularly a branching portion of an exhaust manifold), which serves as an exhaust passage side pipe, is connected to the first connecting surface of the first connecting portion 24.

The second connecting portion 25 has a second connecting surface on the downstream side of the valve receiving chamber (interior passage space 110) of the housing 1 in the flow direction of the EGR gas. The EGR pipe (or a merging portion of the intake duct, particularly a merging portion of an intake manifold), which serves as an intake passage side pipe, is connected to the second connecting surface of the second connecting portion 25.

The housing 1 has first to fourth exhaust gas ports, which are connected to the exhaust passage of the engine, the intake passage of the engine, the inlet side tank chamber (inlet) of the EGR cooler 10 and the outlet side tank chamber (outlet) of the EGR cooler 10, respectively. The first to fourth exhaust gas ports are communicated with the valve receiving chamber (interior passage space 110) defined in the housing 1.

The first to fourth exhaust gas ports are formed by an EGR gas inlet port 31, a cooler inlet port 32, a cooler outlet port 33 and an EGR gas outlet port 34, respectively. The EGR gas inlet port 31 is configured into a circular form and is communicated with the exhaust passage of the engine. The cooler inlet port 32 is configured into a circular or rectangular form and is communicated with the inlet side tank chamber (inlet) of the EGR cooler 10. The cooler outlet port 33 is configured into a circular, rectangular or square form and is communicated with the outlet side tank chamber (outlet) of the EGR cooler 10. The EGR gas outlet port 34 is configured into a circular form and is communicated with the intake passage of the engine.

The EGR gas inlet port 31 is opened in the first connecting surface, which is formed in the first connecting portion of the housing 1. The cooler inlet port 32 and the cooler outlet port 33 are opened on the cooler installation surface of the flange 23 of the housing 1. The EGR gas outlet port 34 is opened in the second connecting surface, which is formed in the second connecting portion 25 of the housing 1.

The first EGR gas passage 11 is a first gas passage (cooler inlet passage) that communicates between the EGR gas inlet port 31 and the cooler inlet port 32 and guides the hot EGR gas (high temperature exhaust gas), which is supplied to the interior (the valve receiving chamber, i.e., the interior passage space 110) of the housing 1 from the exhaust passage of the engine, to the interior (the inlet side tank chamber) of the EGR cooler 10. The first EGR gas passage 11 has a bent passage, which is bent at generally a right angle, and is formed in the middle of the first EGR gas passage 11 (particularly, in the valve receiving chamber, i.e., the interior passage space 110). The bent passage may be formed as a curved passage, which curves moderately.

The second EGR gas passage 12 is a second gas passage (cooler outlet passage) that communicates between the cooler outlet port 33 and the EGR gas outlet port 34 and recirculates the cooled EGR gas (low temperature exhaust gas), which is supplied to the interior (the valve receiving chamber, i.e., the interior passage space 110) of the housing 1 from the outlet side tank chamber of the EGR cooler 10, to the intake passage of the engine. The second EGR gas passage 12 has a sloped passage section, which extends from one location adjacent to the cooler outlet port 33 to another location adjacent to the EGR gas outlet port 34 generally along a straight line that is angled relative to the central axis of the cooler outlet port 33 (the central axis of the cooler outlet port 33).

The bypass passage 13 is a cooler bypass passage (cooler bypass path) that communicates between the EGR gas inlet port 31 and the EGR gas outlet port 34 and guides the hot EGR gas (high temperature exhaust gas), which is supplied to the interior (the valve receiving chamber, i.e., the interior passage space 110) of the housing 1 from the exhaust passage of the engine, to the intake passage of the engine while bypassing the EGR cooler 10.

The EGR valve 3 is configured into a circular disk and is made of a heat resistant material, such as a metal material (e.g., stainless steel). The EGR valve 3 is connected to the rotary gear 6 through the first shaft 21. The EGR valve 3 continuously adjusts an opening degree of the exhaust gas passage (e.g., the first and second EGR gas passages 11, 12 or the bypass passage 13) of the housing 1 through changing of the rotational angle of the EGR valve 3 about the rotational axis of the first shaft 21. In this way, the EGR valve 3 variably changes the flow quantity of the EGR gas, which is recirculated from the exhaust passage to the intake passage (the EGR quantity: the EGR rate relative to the fresh intake air quantity).

Figure 5A:
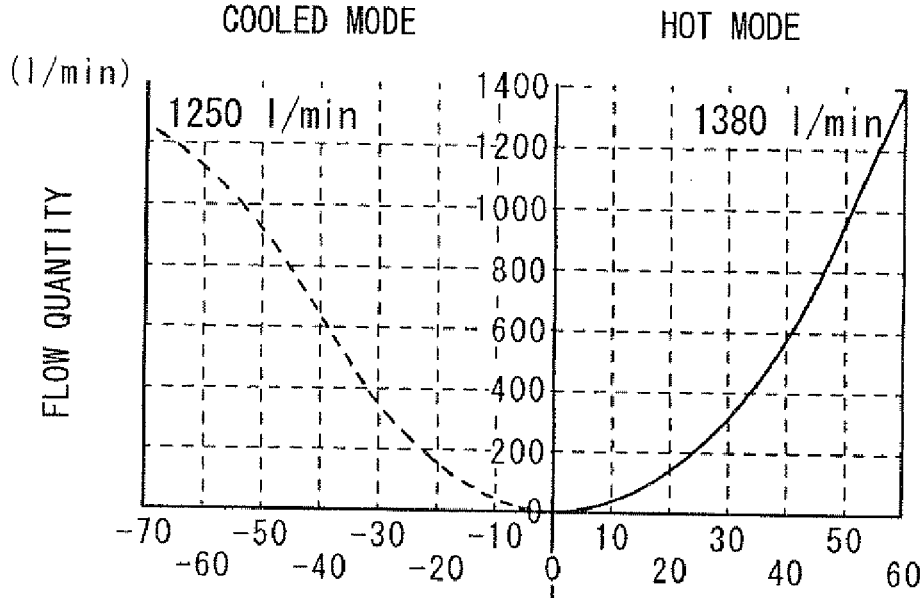
FIG. 5A is a diagram showing a flow quantity characteristic relative to a rotational angle of an EGR valve.
Figure 5B:
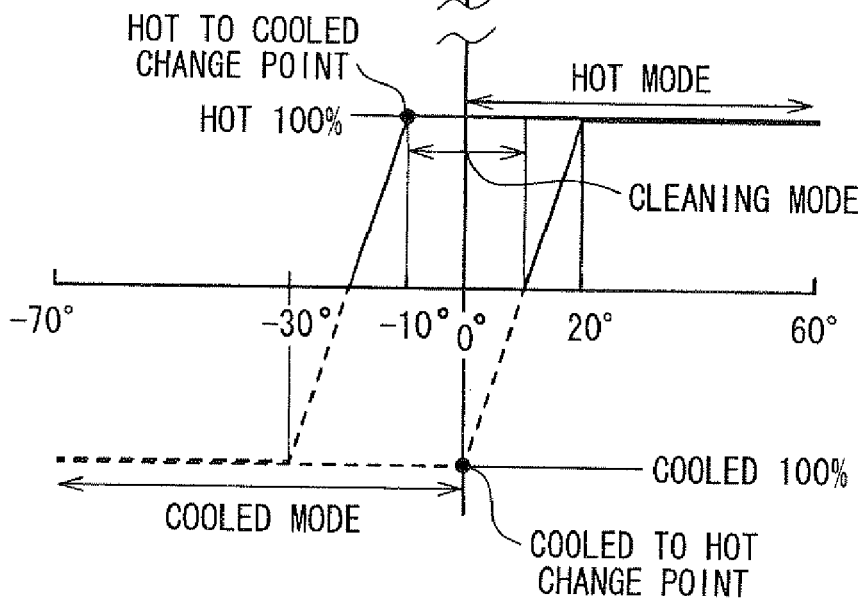
FIG. 5B is a diagram showing a mode change characteristic relative to a rotational angle of a mode change valve.

As shown in FIGS. 5A and 5B, the EGR valve 3 rotates within the valve operational range from the valve full close position ($\theta$=0 degrees) to the valve full open position ($\theta$=+60 degrees or $\theta$=−70 degrees) based on the control signal received from the engine control unit (hereinafter, referred to as ECU) during the operation of the engine. In this way, the rotational angle of the EGR valve 3 is changed, and thereby an opening cross-sectional area of the second EGR gas passage 12 (EGR gas flow cross-sectional area) is changed. Therefore, the EGR quantity is variably controlled.

As shown in FIG. 5A, the rotational angle of the EGR valve 3 and of the rotary gear 6 is changed within the valve operational range from $\theta$=−70 degrees to $\theta$=60 degrees through $\theta$=0 degrees during the mode change operational period from the cooled mode to the hot mode. Here, at the time of starting the energization of the electric motor 5, the rotational angle of the EGR valve 3 and of the rotary gear 6 is set to $\theta$=0 degrees by the first and second springs 61, 62. Therefore, the rotational angle of the EGR valve 3 and of the rotary gear 6 is changed within the valve operational range from $\theta$=0 degrees to $\theta$=60 degrees at the time of starting the mode change operation from the cooled mode to the hot mode.

As shown in FIG. 5A, the rotational angle of the EGR valve 3 and of the rotary gear 6 is changed within the valve operational range from $\theta$=60 degrees to $\theta$=−70 degrees through 0 degrees during the mode change operational period from the hot mode to the cooled mode.

FIG. 5A shows the flow quantity characteristic of the EGR valve 3 relative to the rotational angle of the EGR valve 3. For example, in the case where the temperature of the EGR gas, which flows into the EGR valve module, is 300 degrees Celsius, the flow quantity of the EGR gas is 1,250 liter per minute (l/min) during the cooled mode ($\theta$=−70 degrees), and the flow quantity of the EGR gas is 1,380 liter per minute (l/min) during the hot mode ($\theta$=60 degrees).

The EGR valve 3 is rotatably received in the nozzle 2, which is fitted to the nozzle fitting portion of the housing 1. Furthermore, the EGR valve 3 is stationary fixed to one axial end of the first shaft 21 in the state where the EGR valve 3 is tilted relative to the rotational axis of the first shaft 21 by a predetermined angle.

An annular seal ring groove is formed to circumferentially extend along an outer peripheral surface of the EGR valve 3. A seal ring 35 is fitted into the seal ring groove. The seal ring 35 is configured into a C-shape and is closely engageable with an inner peripheral surface of the nozzle 2 held in the nozzle fitting portion of the housing 1. A radially inner peripheral portion of the seal ring 35 is fitted into the seal ring groove in such a manner that a radially outer peripheral portion of the seal ring 35 radially outwardly projects from the outer peripheral surface of the EGR valve 3.

Therefore, in the EGR valve module of the present embodiment, when the EGR valve 3 is stopped in the valve full close position, i.e., when the EGR valve 3 is placed in the vertical direction that is perpendicular to the passage direction of the second EGR gas passage 12 (the time of the valve full close position of the EGR valve 3), the seal ring 35 seals the gap between the inner peripheral surface of the nozzle 2 and the outer peripheral surface of the EGR valve 3 through use of the radial tension of the seal ring 35, which is fitted into the seal ring groove.

The first shaft 21 of the EGR valve 3 is a cylindrical rotatable shaft, which is made of the metal material (e.g., stainless steel) that is heat resistant and corrosion resistant. The first shaft 21 of the EGR valve 3 extends through the first shaft receiving through hole 14 of the housing 1, so that the first shaft 21 extends linearly in the axial direction of the first shaft receiving through hole 14 from the outside of the shaft bearing portion 15 of the housing 1 to the inside of the shaft bearing portion 15 (specifically, the exhaust gas passage, such as the second EGR gas passage 12 or the bypass passage 13). As shown in FIG. 3, a bushing 36 and an oil seal 37 are securely fitted between the shaft bearing portion 15 of the housing 1 and the first shaft 21 of the EGR valve 3 by, for example, press-fitting.

A slide hole is formed in the bushing 36 to slidably support the first shaft 21 of the EGR valve 3 in such a manner that the first shaft 21 is slidable in the rotational direction thereof. A cylindrical gap (clearance) is formed between the outer peripheral surface of the first shaft 21 and the hole wall surface (the inner peripheral surface) of the slide hole of the bushing 36 to permit the smooth rotation of the first shaft 21 in the slide hole of the bushing 36.

A valve installation portion is formed in the one axial end portion of the first shaft 21 to securely hold the EGR valve 3 with the valve installation portion through welding (the welding serving as a welding means) of the EGR valve 3 to the valve installation portion. A swaging and fixing portion is formed in the other axial end portion of the first shaft 21 to fix the valve gear plate, which is insert molded in the rotary gear 6, through swaging (the swaging serving as a fixing means) of the valve gear plate to the swaging and fixing portion. That is, the rotary gear 6 is installed to the other axial end portion of the first shaft 21.

The mode change valve 4 is made of the metal material (e.g., stainless steel) that is heat resistant and corrosion resistant. The mode change valve 4 is connected to the rotary cam 7 through the second shaft 22, which supports the mode change valve 4. Furthermore, the mode change valve 4 is rotatably received in the valve receiving chamber, i.e., the interior passage space 110 of the housing 1. When the mode change valve 4 is rotated in the valve receiving chamber, i.e., the interior passage space 110 about the rotational axis of the second shaft 22, the communication between the corresponding exhaust gas ports among the first to fourth exhaust gas ports is freely changed.

The mode change valve 4 is of the butterfly type and has a cylindrical axial portion (cylindrical portion) and a rectangular or square valve plate (valve main body of the plate form or the metal plate). The axial portion of the mode change valve 4 extends in the direction of the rotational axis of the second shaft 22. The valve plate of the mode change valve 4 radially outwardly protrudes from the axial portion of the mode change valve 4 on two opposed radial sides of the axial portion in the direction perpendicular to the axial direction of the axial portion.

Each of the opposed axial end surfaces (upper and lower end surfaces in FIG. 3) of the mode change valve 4 is opposed to the passage wall surface (interior wall surface) of the housing 1 while a predetermined gap is provided therebetween.

The mode change valve 4 includes first and second blocks (projecting ribs) 39, which project toward the passage wall surface of the housing 1 from the opposed axial end surfaces of the mode change valve 4, which are opposed to each other in the direction of the rotational axis of the mode change valve 4. The first and second blocks 39 are placed only around the second shaft 22. Specifically, each of the first and second blocks 39 is configured into a cylindrical body, which surrounds the second shaft 22 of the mode change valve 4. In this way, a deposit release gap S is formed between each of the opposed axial end surfaces of the mode change valve 4 and the passage wall surface of the housing 1.

The mode change valve 4 can continuously change the opening degrees of the first and second EGR gas passages 11, 12 and the opening degree of the bypass passage 13 through the adjustment of the operational position of the mode change valve 4. Thereby, the mode change valve 4 can freely adjust a mixing ratio between the flow quantity of the cooled EGR gas, which has passed through the first and second EGR gas passages 11, 12 and has been cooled through the EGR cooler 10, and the flow quantity of the hot EGR gas, which has passed through the bypass passage 13 while bypassing the EGR cooler 10. In this way, the temperature of the EGR gas, which is recirculated to the intake passage, can be controlled.

During the cooled mode, the mode change valve 4 serves as a partition wall, which partitions the valve chamber into the first EGR gas passage 11 side and the second EGR gas passage 12 side. Thereby, when the mode change valve 4 changes the communication between the corresponding exhaust gas ports among the first to fourth exhaust gas ports, the first and second EGR gas passages 11, 12 are formed in the interior passage space 110 of the housing 1.

Furthermore, during the hot mode, the mode change valve 4 serves as a partition wall, which partitions the valve chamber into the EGR cooler 10 side and the bypass passage 13 side. In this way, when the state of the communication between the corresponding exhaust gas ports among the first to fourth gas ports is changed through the operation of the mode change valve 4, the bypass passage 13 is formed in the interior passage space 110 of the housing 1.

Figure 16:
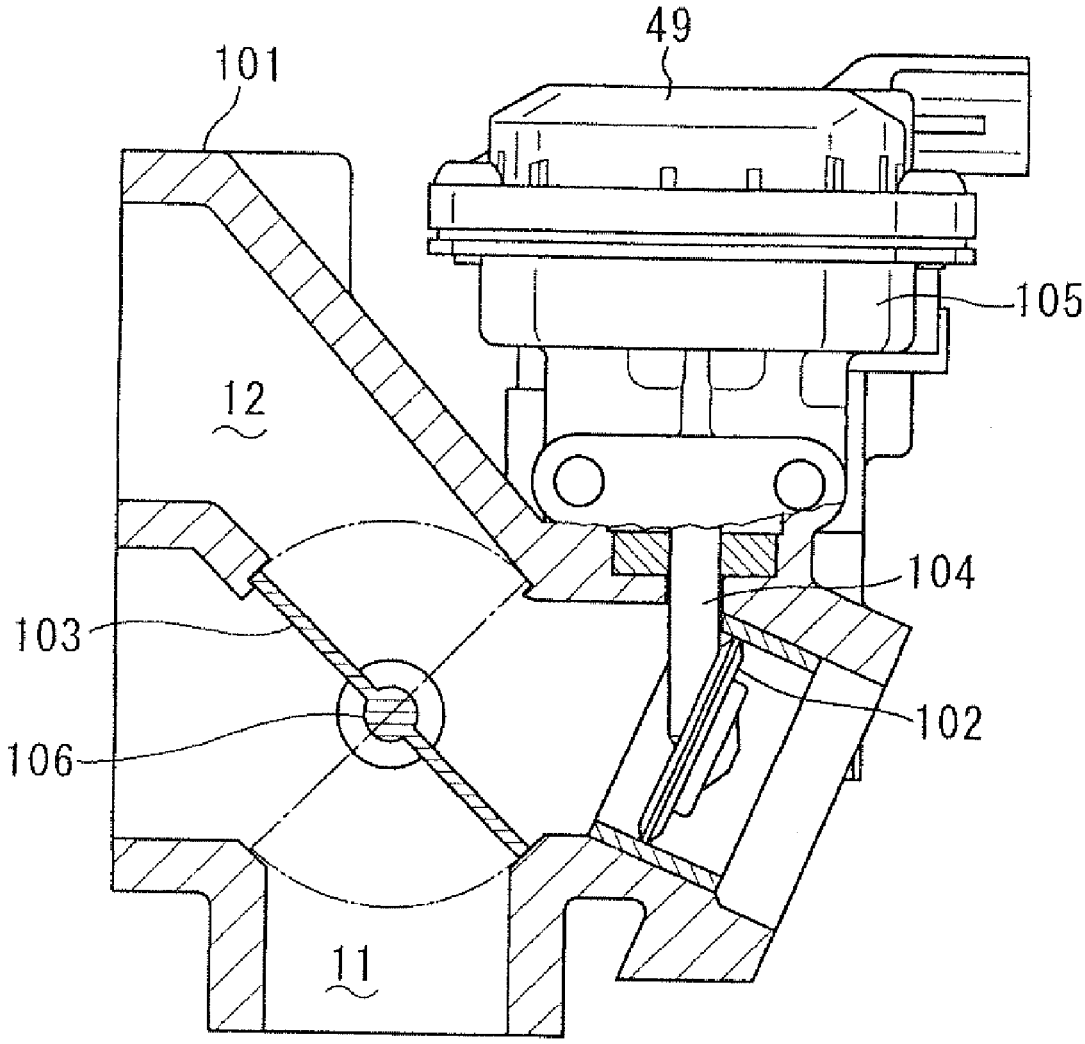
FIG. 16 PRIOR ART
FIG. 16 is a cross-sectional view showing a mode change valve in a cooled mode according to a prior art.
Figure 17:
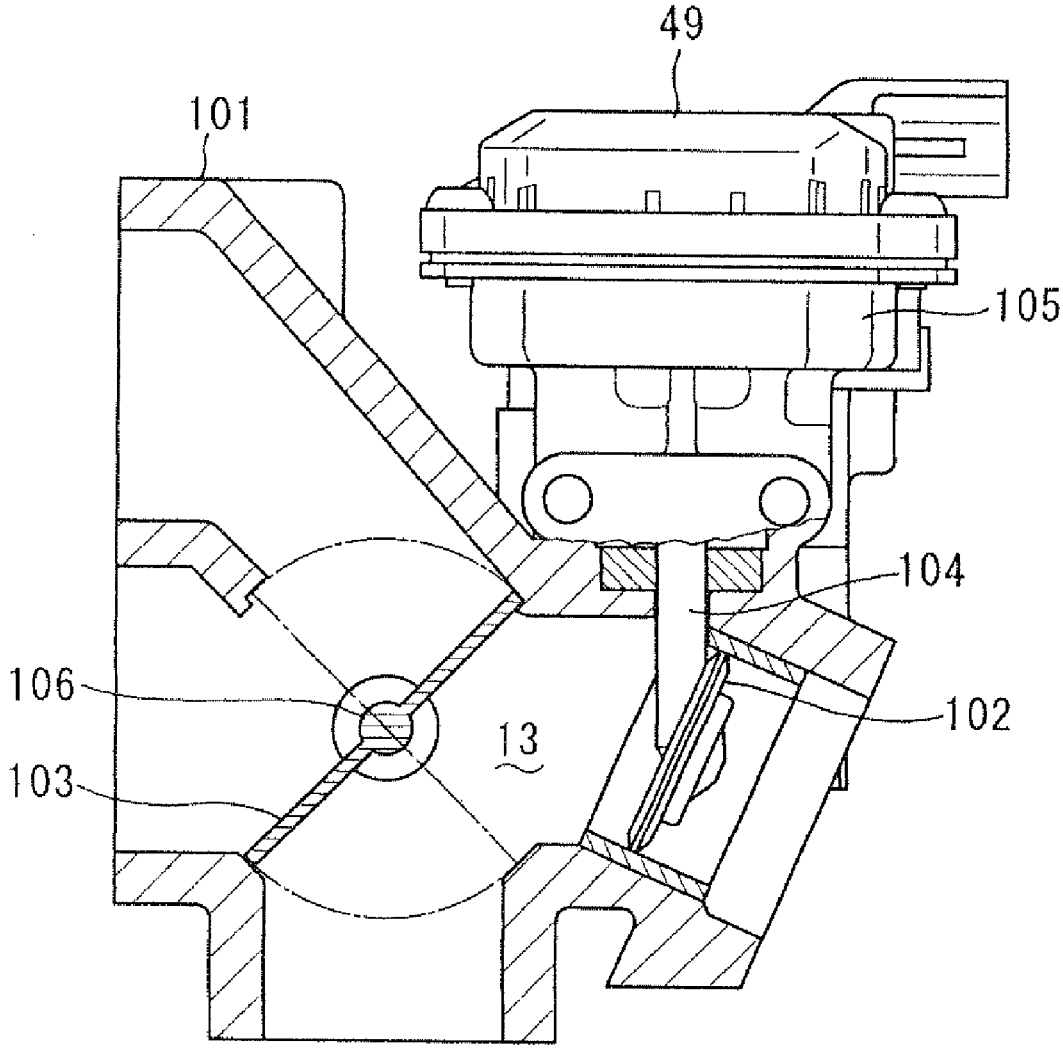
FIG. 17 PRIOR ART
FIG. 17 is a cross-sectional view showing the mode change valve in a bypass mode according to the prior art shown in FIG. 16.

Here, the mode change valve 4 of the present embodiment can continuously change the operational position thereof throughout the operational range thereof from a bypass full close position, at which the flow quantity of the cooled EGR gas is maximized (the cooled mode indicated in FIGS. 1 and 16), to a bypass full open position (the hot mode indicated in FIG. 17). Here, it should be noted that the bypass full close position of the mode change valve 4 is the position, at which the mode change valve 4 fully closes the bypass passage 13. Also, the bypass full open position of the mode change valve 4 is the position, at which the mode change valve 4 fully opens the bypass passage 13.

During the changing of the operational mode of the mode change valve 4 from the cooled mode to the hot mode and also from the hot mode to the cooled mode, the mode change valve 4 is placed in a state of an intermediate opening degree between the bypass full close position and the bypass full open position, i.e., in an intermediate operational position (mixing position), at which the cooled EGR gas and the hot EGR gas are mixed together. At this time, the internal passage of the housing 1 is set to a hot/cooled mixing mode.

The second shaft 22 of the mode change valve 4 is a cylindrical rotatable shaft, which is made of the metal material (e.g., stainless steel) that is heat resistant and corrosion resistant. The second shaft 22 of the mode change valve 4 extends through the second shaft receiving through hole 16 of the housing 1, so that the second shaft 22 extends linearly in the axial direction of the second shaft receiving through hole 16 from the outside of the shaft bearing portion 17 of the housing 1 to the inside of the shaft bearing portion 17 (specifically, the exhaust gas passage, such as the valve receiving chamber, i.e., the interior passage space 110). As shown in FIG. 3, a bushing 41 and bearings 42, 43 are securely fitted between the shaft bearing portion 17 of the housing 1 and the second shaft 22 of the mode change valve 4 by, for example, press-fitting.

Furthermore, the first shaft 21 and the second shaft 22 are spaced from each other by a predetermined distance in the interior of the housing 1.

A slide hole is formed in each of the bushing 41 and the bearings 42, 43 to slidably support the second shaft 22 of the mode change valve 4 in such a manner that the second shaft 22 is slidable in the rotational direction thereof. A cylindrical gap (clearance) is formed between the outer peripheral surface of the second shaft 22 and the hole wall surface (the inner peripheral surface) of the slide hole of each of the bushing 41 and the bearings 42, 43 to permit the smooth rotation of the second shaft 22 in the slide hole of each of the bushing 41 and the bearings 42, 43. Alternatively, the bearing 43 may be eliminated, if desired.

A valve plate (metal plate) of the mode change valve 4 is securely welded to one axial end portion of the second shaft 22. The rotary cam 7 is installed to the other axial end portion of the second shaft 22. The second shaft 22 has an engaging portion, which has two diametrically opposed planar engaging surfaces, and is connected to the rotary cam 7. Thereby, the relative rotation between the rotary cam 7 and the second shaft 22 is limited.

The electric actuator 100 has an actuator main body that includes a housing, an opening of which is closed with a sensor cover 49 (see FIGS. 16 and 17). The housing of the electric actuator 100 is a die-cast product that is made of aluminum alloy, which includes aluminum as its main component. The housing of the electric actuator 100 is connected (fixed) to an actuator installation portion of the housing 1, which is formed in an outer wall of the housing 1, with fixing bolts.

Furthermore, the electric motor (e.g., a DC motor) 5 and the drive force transmitting mechanism 50 are provided between the outer wall of the housing 1 and the housing of the electric actuator 100. The electric motor 5 generates the drive torque upon energization thereof. The drive force transmitting mechanism 50 includes the rotary gear 6, the rotary cam 7 and the spring 8. The rotary gear 6 transmits the drive torque of the electric motor 5 to the EGR valve 3 to drive the same. The rotary cam 7 transmits the drive torque of the electric motor 5 to the mode change valve 4 to drive the same. The spring 8 urges the rotary cam 7 toward the rotary gear 6. The drive force transmitting mechanism 50 releasably links the rotary cam 7 to the rotary gear 6.

The electric motor 5 generates the drive torque, which drives the EGR valve 3 and the mode change valve 4. The electric motor 5 is securely held in the motor housing (not shown), which is formed integrally in the outer wall of the housing 1.

The drive force transmitting mechanism 50 includes the speed reducing gear mechanism, which reduces the rotational speed of the electric motor 5 through two speed reducing stages to implement a predetermined speed reducing ratio, so that the drive torque of the electric motor 5 is increased.

The speed reducing gear mechanism transmits the torque (drive torque) of the output shaft of the electric motor 5 to the first shaft 21 of the EGR valve 3 and the second shaft 22 of the mode change valve 4. The first to third gears of the speed reducing mechanism are rotatably received in the internal space, which is formed between the outer wall of the housing 1 and the housing of the electric actuator 100.

The speed reducing gear mechanism includes a motor gear (pinion gear, first gear) 51, an intermediate speed reducing gear (second gear) 52 and the rotary gear (third gear) 6. The motor gear 51 is fixed to the output shaft of the electric motor 5. The intermediate speed reducing gear (second gear) 52 is meshed with the motor gear 51 and is rotated by the motor gear 51. The rotary gear 6 is meshed with the intermediate speed reducing gear 52 and is rotated by the intermediate speed reducing gear 52.

The intermediate speed reducing gear 52 includes teeth (large diameter gear portion) 54, which are meshed with teeth of the motor gear 51, and teeth (small diameter gear portion) 55, which are meshed with teeth of the rotary gear 6.

Teeth (final speed reducing gear portion) 56, which are meshed with the small diameter gear portion 55 of the intermediate speed reducing gear 52, are formed in a circumferential portion (arcuate portion) of an outer peripheral portion of the rotary gear 6. The output shaft of the electric motor 5 may be directly connected to the rotary gear 6, if desired. In such a case, the rotary gear 6 is not the gear plate, which has the final speed reducing gear portion 56 in the outer peripheral part of the rotary gear 6. Rather, the rotary gear 6 is the rotary plate, which transmits the drive torque of the electric motor 5 to the EGR valve 3 to rotate the same.

Furthermore, the rotary gear 6 has a cylindrical portion 57, which surrounds an actuator side axial end portion of the first shaft 21 of the EGR valve 3. The valve gear plate, which is made of the metal material, is insert molded in the inner peripheral part of the cylindrical portion 57.

First and second springs 61, 62 are received between the rotary gear 6 and a sleeve 59, which is fixed to the housing 1, to exert an urging force (spring load) that urges the EGR valve 3 and the mode change valve 4 in the valve closing direction (or in the valve opening direction). The first and second springs 61, 62 serve as a return spring and a default spring, respectively. The return spring applies the urging force (spring load), which urges the EGR valve 3 in the valve closing direction relative to the rotary gear 6. The default spring applies the urging force (spring load), which urges the EGR valve 3 in the valve opening direction relative to the rotary gear 6.

Furthermore, the rotary gear 6 has a roller shaft (arm pin) 63 at a location, which is radially outward of the rotational axis of the rotary gear 6 (specifically, the rotational axis of the first rotatable shaft, i.e., the first shaft 21). The arm pin 63 projects at one side of the rotary gear 6 (the housing side, the EGR valve side) in the plate thickness direction of the rotary gear 6. In other words, the arm pin 63 projects from one axial side of the rotary gear 6 in the direction parallel to the axial direction of the first shaft 21. The arm pin 63 is provided (integrally formed) in a rear surface of an outer projecting portion (block) 64, which radially outwardly projects from the rest of the outer peripheral surface of the rotary gear 6. The arm pin 63 revolves about the rotational axis of the rotary gear 6 upon the rotation of the rotary gear 6.

The rotary gear 6 has an engaging element, which is rotatable about an rotational axis thereof. The engaging element of the rotary gear 6 is a roller 65, which is engageable and disengageable relative to a cam profile (cam face **7*a*1 of a cam portion 7*a* shown in FIG. 9) of the rotary cam 7. The roller 65 is fitted to an outer peripheral surface of the arm pin 63 in such a manner that the roller 65 is rotatable relative to the arm pin 63. The roller 65 revolves about the rotational axis of the rotary gear 6 upon the rotation of the rotary gear 6 and rotates about the arm pin 63. The roller 65 contacts the cam profile (cam face 7*a*1) of the rotary cam 7 in such a manner that the roller 65 rolls along the cam profile (cam face 7*a*1) of the rotary cam 7 and is engageable and disengageable relative to the cam profile (cam face 7*a*1) of the rotary cam 7. When the roller 65 of the rotary gear 6 is in rolling contact with the cam profile (cam face 7*a*1) of the rotary cam 7, the rotary cam 7 is linked to the rotary gear 6**.

In place of the roller 65, which is supported by the arm pin 63 in the rotatable manner relative to the arm pin 63, a roller bearing, which is press fitted to the outer peripheral surface of the arm pin 63, may be used.

The rotary cam 7 is made of a metal material or synthetic resin material and is configured into a predetermined shape. The rotary cam 7 has a shaft holding portion 70 and two cam arms 71, 72. The axial end portion of the second shaft 22, which is opposite from the mode change valve 4, is fitted to and is held by a corresponding fitting hole of the shaft holding portion 70. The cam arms 71, 72 extend arcuately from two sides of the shaft holding portion 70. A curved portion is provided in each of the shaft holding portion 70 and the cam arms 71, 72.

The rotary cam 7 has two spring seat surfaces 73, 74. The spring seat surface 73 extends linearly from an outer wall surface (center portion) of a corner of the curved portion of the shaft holding portion 70 to an outer wall surface of a corner of the curved portion of the cam arm 72. The spring seat surface 74 extends linearly from the outer wall surface (center portion) of the corner of the curved portion of the shaft holding portion 70 to an outer wall surface of a corner of the curved portion of the cam arm 71.

Figure 12:
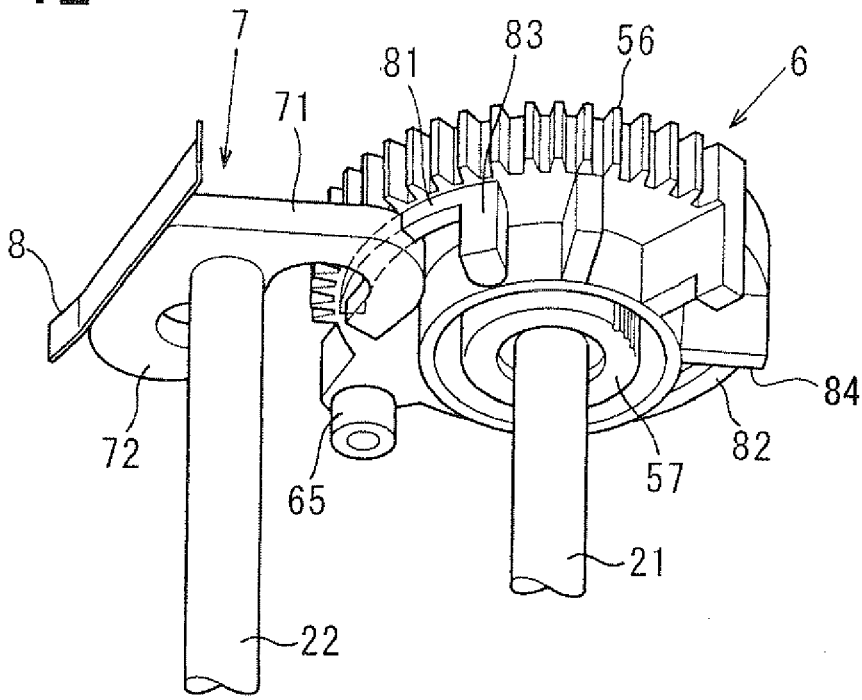
FIG. 12 is a perspective view showing a cooled mode side lock state according to the first embodiment.
Figure 13:
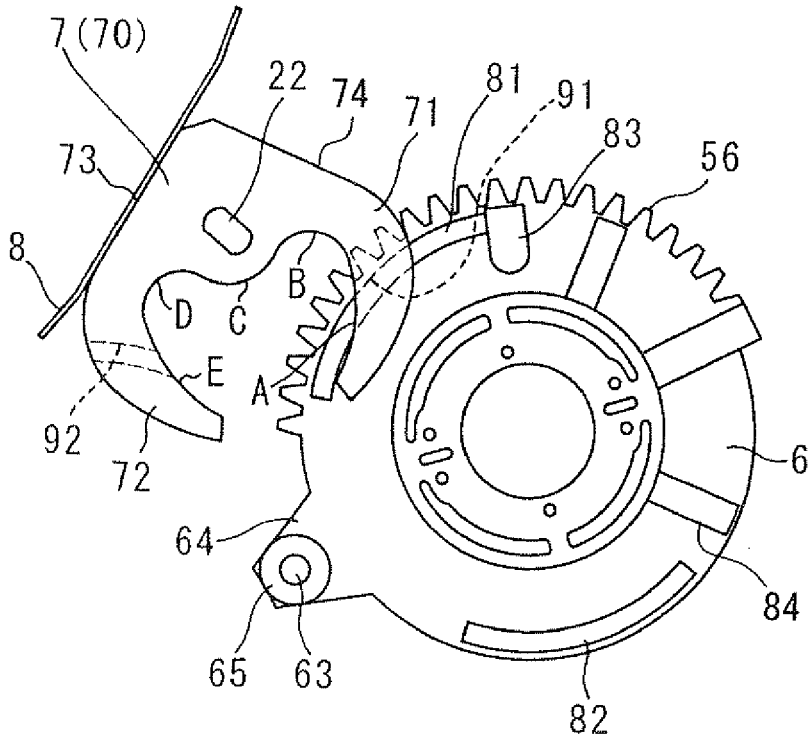
FIG. 13 is a descriptive view showing a cooled mode side lock state according to the first embodiment.

The spring seat surface 73 is configured such that the spring 8 contacts the spring seat surface 73 throughout the corresponding mode change operation from the cooled mode side lock state, in which a guard 81 of the rotary gear 6 locks (limits) the movement (rotational movement) of the rotary cam 7, to an intermediate positional state (see FIGS. 12 and 13).

The spring seat surface 74 is configured such that the spring 8 contacts the spring seat surface 74 throughout the corresponding mode change operation from the hot mode side lock state, in which a guard 82 of the rotary gear 6 locks (limits) the movement (rotational movement) of the rotary cam 7, to the intermediate positional state (see FIGS. 7 to 11).

The rotary cam 7 has a slot 75, into which the roller 65 of the rotary gear 6 is received in a synchronization range of the EGR valve 3 and the mode change valve 4, in which the EGR valve 3 and the mode change valve 4 are synchronized with each other. Two opposing portions are provided at distal ends, respectively, of the cam arms 71, 72, which are opposed to each other while a predetermined gap (slot opening 76) is interposed therebetween.

The cam portion 7*a* of the rotary cam 7 includes a cam recess A, a cam recess B, a cam protrusion C, a cam recess D and a cam recess E and is engaged with the roller 65 of the rotary gear 6 in the synchronization range of the EGR valve 3 and the mode change valve 4.

The cam recess A is a cam valley that forms a section (insensible area), in which the rotational angle of the mode change valve 4 and of the rotary cam 7 do not change in response to a change in the rotational angle of the EGR valve 3 and of the rotary gear 6 in the synchronization range of the EGR valve 3 and the mode change valve 4, particularly in the mode change operation from the cooled mode to the hot mode.

The cam recess B is a cam valley that generates the large rotational drive force (drive torque) when the rotational angle (cam rotational angle) of the mode change valve 4 and of the rotary cam 7 is in a small range (small operational angular range of the rotary cam 7) in the synchronization range of the EGR valve 3 and the mode change valve 4, particularly in the mode change operation from the hot mode to the cooled mode.

The cam protrusion C is a cam peak that receives the rotational drive force (the drive torque of the electric motor 5) upon urging of the roller 65 of the rotary gear 6 against the cam protrusion C in the synchronization range of the EGR valve 3 and the mode change valve 4, particularly in the range from the cooled to hot mode change point to the hot mode (100%) or in the range from the hot to cooled mode change point to the cooled mode (100%).

The cam recess D is a cam valley that generates the large rotational drive force (drive torque) when the rotational angle (cam rotational angle) of the mode change valve 4 and of the rotary cam 7 is in the small range (small operational angular range of the rotary cam 7) in the synchronization range of the EGR valve 3 and the mode change valve 4, particularly in the mode change operation from the cooled mode to the hot mode.

The cam recess E is a cam valley that forms a section (insensitive area), in which the rotational angle of the mode change valve 4 and of the rotary cam 7 do not change in response to a change in the rotational angle of the EGR valve 3 and of the rotary gear 6 in the synchronization range of the EGR valve 3 and the mode change valve 4, particularly in the mode change operation from the hot mode to the cooled mode.

The cam portion 7*a* (i.e., the cam recess A, the cam recess B, the cam protrusion C, the cam recess D and the cam recess E) of the rotary cam 7 has the cam profile (cam face 7*a*1), which is configured to correspond with the mode change characteristic (see characteristic diagrams of FIGS. 5A to 6) of the mode change valve 4 relative to the rotational angle of the EGR valve 3 and of the rotary gear 6.

Figure 6:
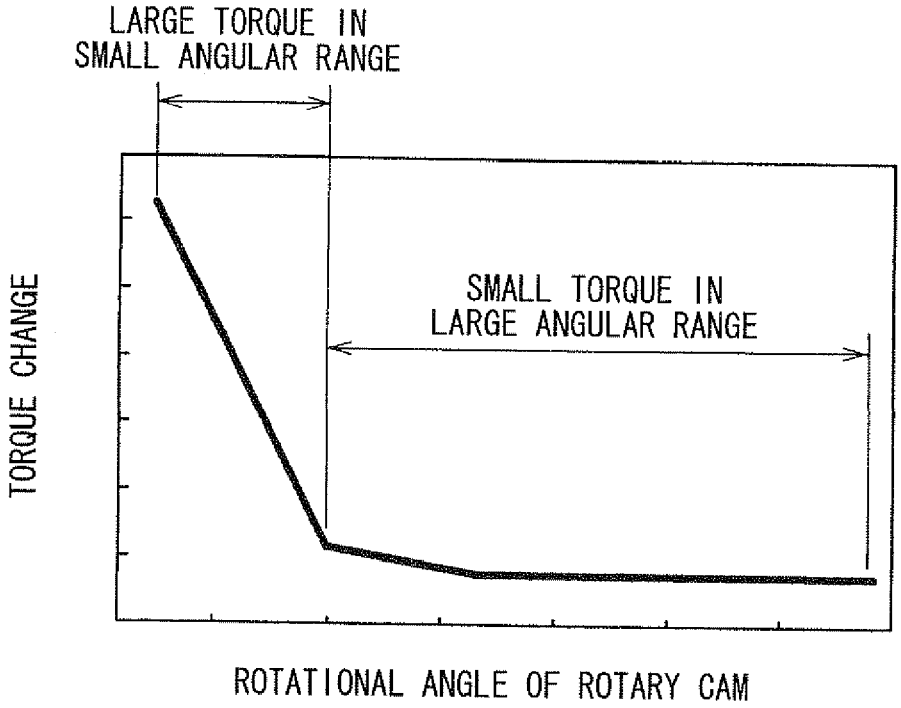
FIG. 6 is a diagram showing a torque change characteristic relative to a rotational angle of a rotary cam according to the first embodiment.

With reference to FIG. 6, the cam profile of the rotary cam 7 is constructed (configured) such that the torque, which is exerted in the small angular range (absolute angular range) of the mode change valve 4 and the rotary cam 7 relative to the roller 65 of the rotary gear 6, is larger than the torque, which is exerted in the large angular range (absolute angular range) of the mode change valve 4 and the rotary cam 7 relative to the roller 65 of the rotary gear 6. Furthermore, the cam profile of the rotary cam 7 is configured to have the area (the cam protrusion C), at which a change in the rotational angle of the mode change valve 4 in response to a change in the rotational angle of the rotary gear 6 is larger than that of another area (e.g., the cam recesses A, E) of the cam profile of the rotary cam 7 in the linked state of the rotary cam 7 relative to the rotary gear 6.

With reference to FIGS. 5A and 5B, at the time of changing from the cooled mode to the hot mode, the cooled mode is set while the mode change valve 4 and the rotary cam 7 are placed in the corresponding angular range on the left side of the cooled to hot mode change point, at which the operational mode is changed from the cooled mode to the hot mode, in FIG. 5B. Also, the hot mode is set while the mode change valve 4 and the rotary cam 7 are placed in the corresponding angular range on the right side of the cooled to hot mode change point in FIG. 5B.

At the time of changing from the hot mode to the cooled mode, the hot mode is set while the mode change valve 4 and the rotary cam 7 are placed in the corresponding angular range on the right side of the hot to cooled mode change point, at which the operational mode is changed from the hot mode to the cooled mode, in FIG. 5B. Also, the cooled mode is set while the mode change valve 4 and the rotary cam 7 are placed in the corresponding angular range on the left side of the hot to cooled mode change point in FIG. 5B.

The cam profile of the rotary cam 7 is configured to have the hysteresis in the mode change characteristic of the mode change valve 4 relative to the rotational angle of the rotary gear 6 in each of the cooled to hot mode change period and the hot to cooled mode change period, as shown in FIGS. 5A and 5B.

The engine vibrations and the vehicle body vibrations may be conducted to the housing 1 and then to the second shaft 22 and the rotary cam 7 while the rotary cam 7 is not linked to the rotary gear 6. These vibrations may cause rattling or jittering movement of the mode change valve 4 and the rotary cam 7 about the rotational axis of the second shaft 22 in the rotational direction. Furthermore, the intake pulsation torque or exhaust pulsation torque, which is generated in response to the reciprocal movement of the piston in each corresponding cylinder and the opening and closing movements of the intake or exhaust valve, may be applied to the mode change valve 4 provided in the interior passage space 110 of the housing 1, which recirculates the EGR gas from the exhaust passage to the intake passage of the engine. Also, the pressure fluctuations caused by, for example, backfire may be applied to the mode change valve 4. This may cause the rattling or jittering movement of the mode change valve 4 and the rotary cam 7 about the rotational axis of the second shaft 22 in the rotational direction. These rattling or jittering movements of the mode change valve 4 and the rotary cam 7 may possibly result in the following abnormalities (erroneous movements). Specifically, the rotary cam 7 may be abnormally displaced from the rotary gear 6. Also, the positional relationship between the roller 65 of the rotary gear 6 and the slot opening 76 of the rotary cam 7 may be deviated from its proper positional relationship. In these cases, it may no longer be possible to link the rotary cam 7 to the rotary gear 6 (possibly resulting in, for example, overturn of the mode change valve 4).

In view of the above disadvantages, the drive force transmitting mechanism of the present embodiment includes a valve lock mechanism (valve limiting means), which limits the rotational movement of the mode change valve 4 and the rotary cam 7 about the rotational axis of the rotary cam 7 (rotational axis of the second rotatable shaft, i.e., the second shaft 22) in the unlinked state of the rotary cam 7 relative to the rotary gear 6.

The valve lock mechanism includes the guards (arcuate ridges or arcuate engaging protrusions) 81, 82, which protrude from the rear surface of the rotary gear 6, and engaging grooves 91, 92, which are provided to the front surface of the rotary cam 7 and are engageable and disengageable relative to the guards 81, 82, respectively.

The guard 81 of the rotary gear 6 is a cooled side arcuate engaging protrusion, which has a predetermined radius of curvature about the rotational axis of the rotary gear 6. One circumferential end portion of the guard 81 has an engagement start portion, at which the engagement between the guard 81 and the engaging groove 91 starts. A stopper 83 is provided at the other circumferential end portion of the guard 81 to limit further rotation of the rotary gear 6 toward the cooled mode side valve opening direction thereof upon engagement of the spring seat surface 73 of the cam arm 72 of the rotary cam 7 with the spring 8. Specifically, the stopper 83 defines the limit position (at the rotational angle of −70 degrees) within the cooled mode side operable range of the rotary gear 6. In the present embodiment, although the stopper 83 is provided at the other circumferential end portion of the guard 81, the stopper 83 may be alternatively placed such that a predetermined circumferential gap is formed between the stopper 83 and the circumferential end surface of the other circumferential end portion of the guard 81.

The guard 82 is a hot side arcuate engaging protrusion, which has a predetermined radius of curvature about the rotational axis of the rotary gear 6. One circumferential end portion of the guard 82 has an engagement start portion, at which the engagement between the guard 82 and the engaging groove 92 starts. A stopper 84 is provided at the other circumferential end portion of the guard 82 such that a predetermined circumferential gap is interposed between the stopper 84 and the other circumferential end portion of the guard 82. The stopper 84 limits further rotation of the rotary gear 6 toward the hot mode side valve opening direction thereof upon engagement of the spring seat surface 74 of the cam arm 71 of the rotary cam 7 with the spring 8. Specifically, the stopper 84 defines the limit position (at the rotational angle of 60 degrees) within the hot mode side operable range of the rotary gear 6. In the present embodiment, although the stopper 84 is provided at the other circumferential end portion of the guard 82 such that the predetermined circumferential gap is provided between the stopper 84 and the other circumferential end portion of the guard 82. Alternatively, the stopper 84 may be formed integrally at the other circumferential end portion of the guard 82.

The engaging groove 91 of the rotary cam 7 is formed in the front surface of the cam arm 71 and serves as a cooled side engaging recess that is arcuate and has a predetermined radius of curvature, which corresponds to that of the guard 81. In the state where the rotary cam 7 is not linked to the rotary gear 6 upon removal of the roller 65 of the rotary gear 6 from the slot opening 76 (in the cooled mode), the engaging groove 91 is engaged with the guard 81. At this time, the guard 81 is slidably fitted into the engaging groove 91. The engaging groove 92 is formed in the front surface of the cam arm 72 and serves as a hot side engaging recess that is arcuate and has a predetermined radius of curvature, which corresponds to that of the guard 82. In the state where the rotary cam 7 is not linked to the rotary gear 6 upon removal of the roller 65 of the rotary gear 6 from the slot opening 76 (in the hot mode), the engaging groove 92 is engaged with the guard 82. At this time, the guard 82 is slidably fitted into the engaging groove 92.

In this way, in the unlinked state of the rotary cam 7 relative to the rotary gear 6 where the rotary cam 7 is not linked to the rotary gear 6 due to the influences of, for example, the engine vibrations, the vehicle body vibrations or abnormal high pressure pulsations, it is possible to limit the erroneous movements (e.g., the overturn of the mode change valve 4), more specifically, the abnormal displacement of the rotary cam 7 away from the rotary gear 6 or the deviation of the positional relationship of the roller 65 of the rotary gear 6 relative to the slot opening 76 of the rotary cam 7, which may possibly limit reestablishment of the linkage between the rotary cam 7 and the rotary gear 6.

The drive force transmitting mechanism 50 is constructed such that in the cooled mode where the rotary cam 7 is not linked to the rotary gear 6, when the rotational angle of the EGR valve 3 is in the angular range of −70 degrees to −30 degrees, the guard 81, which is formed in the rear surface of the rotary gear 6, is engaged (locked) with the engaging groove 91, which is formed in the front surface of the cam arm 71 of the rotary cam 7. The drive force transmitting mechanism 50 is also constructed such that in the hot mode where the rotary cam 7 is not linked to the rotary gear 6, when the rotational angle of the EGR valve 3 is in the angular range of +20 degrees to +60 degrees, the guard 82, which is formed in the rear surface of the rotary gear 6, is engaged (locked) with the engaging groove 92, which is formed in the front surface of the cam arm 72 of the rotary cam 7. Furthermore, when the rotational angle of the EGR valve 3 is in the range of −30 degrees to +20 degrees, the engagement between the guard 81 and the engaging groove 91 or the engagement between the guard 82 and the engaging groove 92 is released (unlocked).

The electric actuator 100 includes the spring (valve limiting means) 8, which limits the rotational movement of the rotary cam 7 about the rotational axis of the rotary cam 7 in the unlinked state of the rotary cam 7 where the rotary cam 7 is not linked to the rotary gear 6. The spring 8 is a leaf spring, which is provided in the housing of the electric actuator 100 and exerts the urging force (spring force) against the rotary cam 7 to urge the rotary cam 7 toward the rotary gear 6. The contact location of the rotary cam 7, which contacts the spring 8, is changed from the one contact location to the other contact location whenever the roller 65 of the rotary gear 6 is moved along the cam profile of the rotary cam 7 from one side of the cam protrusion C to the other side of the cam protrusion C beyond the apex of the cam protrusion C, and vice versa.

Thereby, in the unlinked state of the rotary cam 7 relative to the rotary gear 6 where the rotary cam 7 is not linked to the rotary gear 6 due to the influences of, for example, the engine vibrations, the vehicle body vibrations or abnormal high pressure pulsations, it is possible to limit the erroneous movements (e.g., the overturn of the mode change valve 4), more specifically, the abnormal displacement of the rotary cam 7 away from the rotary gear 6 or the deviation of the positional relationship of the roller 65 of the rotary gear 6 relative to the slot opening 76 of the rotary cam 7, which may possibly limit reestablishment of the linkage between the rotary cam 7 and the rotary gear 6.

The ECU controls the electric power supply to the electric motor 5, which is the drive power source of the electric actuator 100.

The ECU has a microcomputer of a known structure, which includes a CPU, a storage device (a memory such as a ROM, a RAM), an input circuit (an input device) and an output circuit (an output device). The CPU executes control processes and computing processes. The storage device stores various programs and data.

When the ignition switch (not shown) is turned on, the ECU electronically controls the valve opening degree (rotational angle) of the EGR valve 3 and the valve opening degree (rotational angle) of the mode change valve 4. Furthermore, when the ignition switch is turned off (IG OFF), the above control operation of the ECU, which is executed by the control program stored in the memory, is forcefully terminated.

The sensor signals, which are supplied from the various sensors, undergo the analogue to digital conversion through an A/D converter and are fed to the microcomputer of the ECU. A crank angle sensor, an accelerator opening degree sensor (accelerator pedal position sensor), a coolant temperature sensor, an intake air temperature sensor, an EGR gas flow sensor and an EGR gas temperature sensor are connected to the microcomputer.

The EGR gas flow sensor is securely held in a sensor holding portion, which is provided in the interior of the sensor cover 49. The EGR gas flow sensor converts the rotational angle (valve opening degree) of the EGR valve 3 and outputs a signal, which indicates the opening degree of the EGR valve 3 to the ECU.

Figure 7:
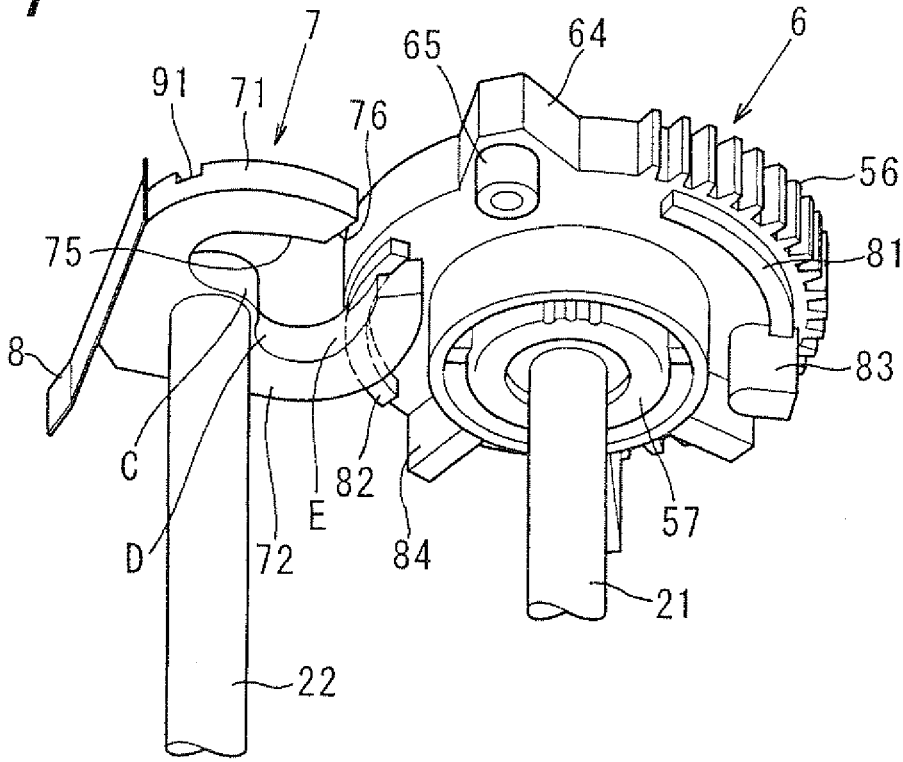
FIG. 7 is a perspective view showing a hot mode side lock state according to the first embodiment.
Figure 8:
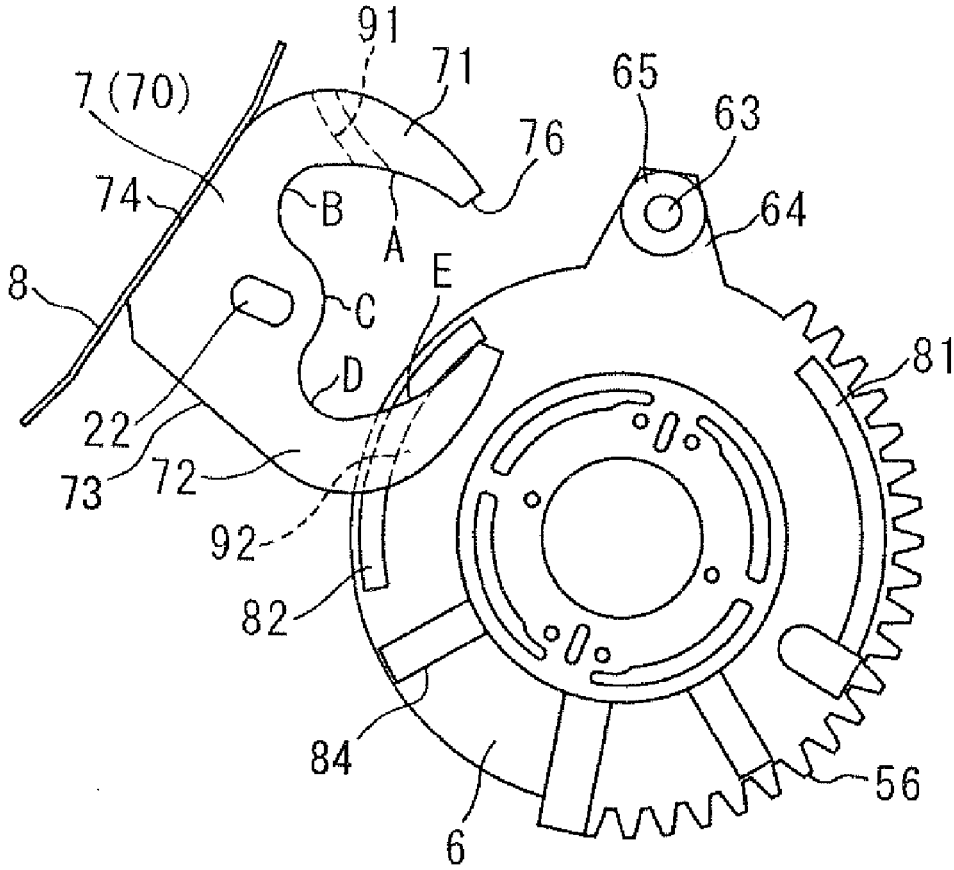
FIG. 8 is a descriptive view showing a hot mode side lock state according to the first embodiment.
Figure 9:
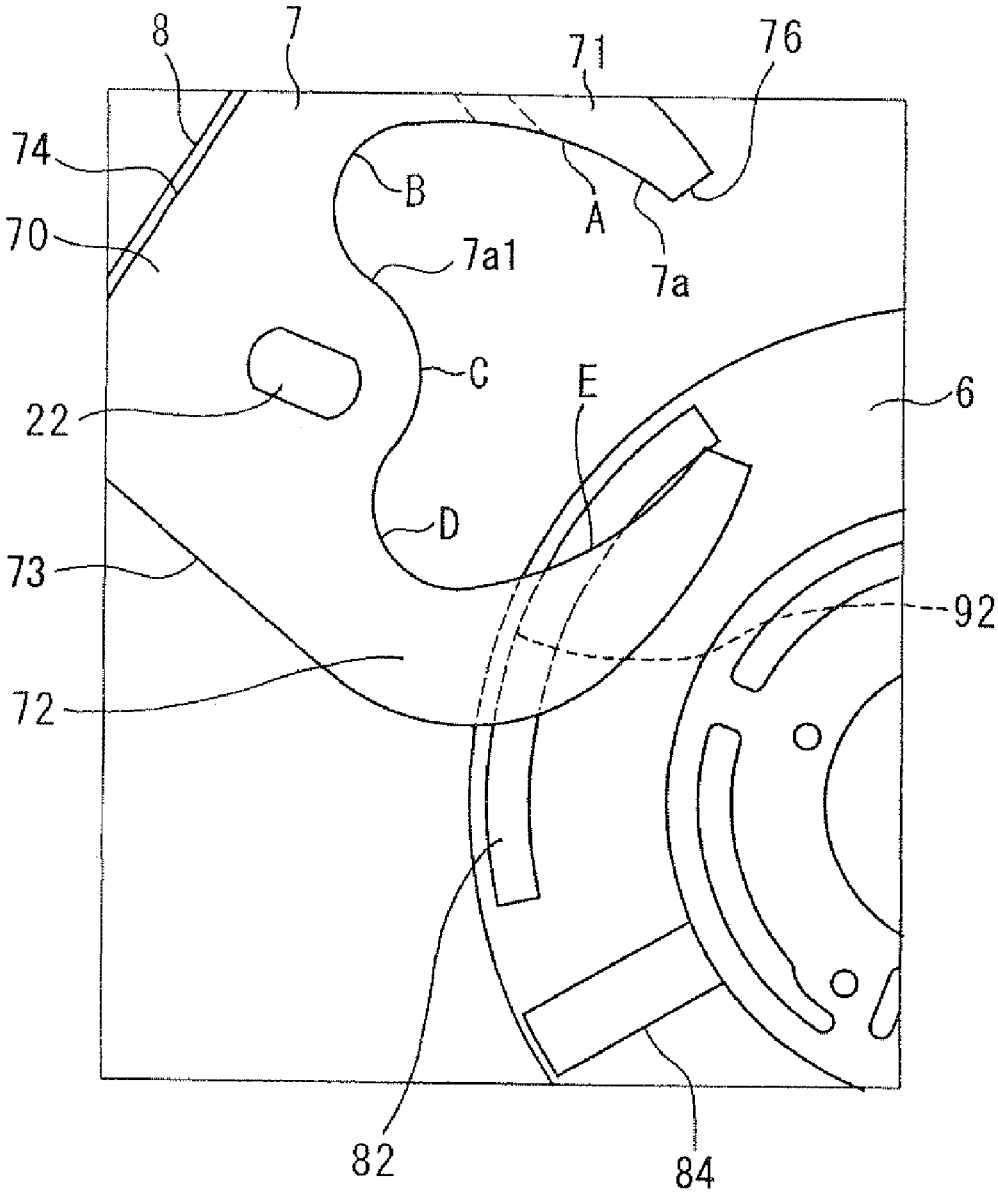
FIG. 9 is an enlarged view showing the hot mode side lock state of FIG. 8 according to the first embodiment.
Figure 10:
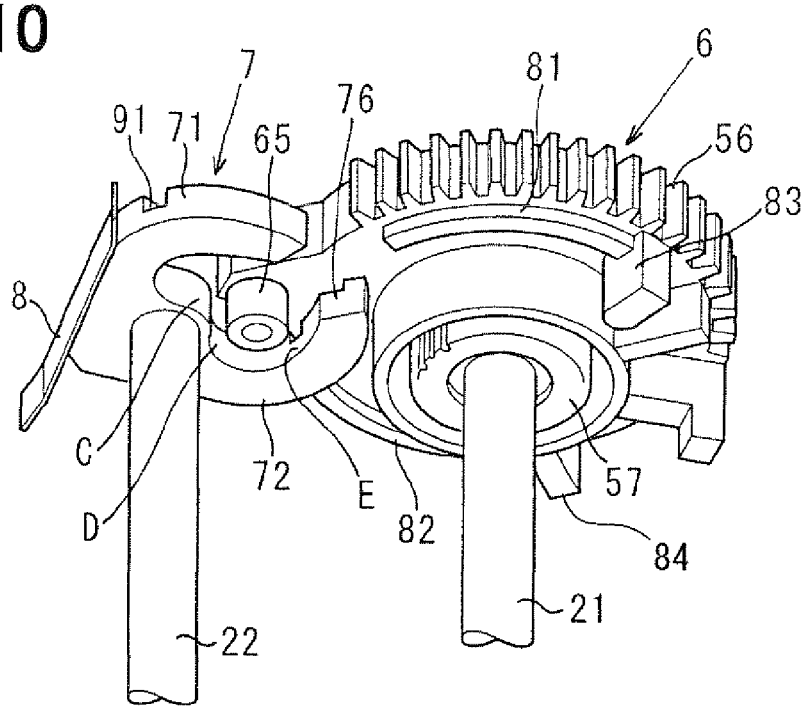
FIG. 10 is a perspective view showing an intermediate positional state during a mode change operation according to the first embodiment.
Figure 11:
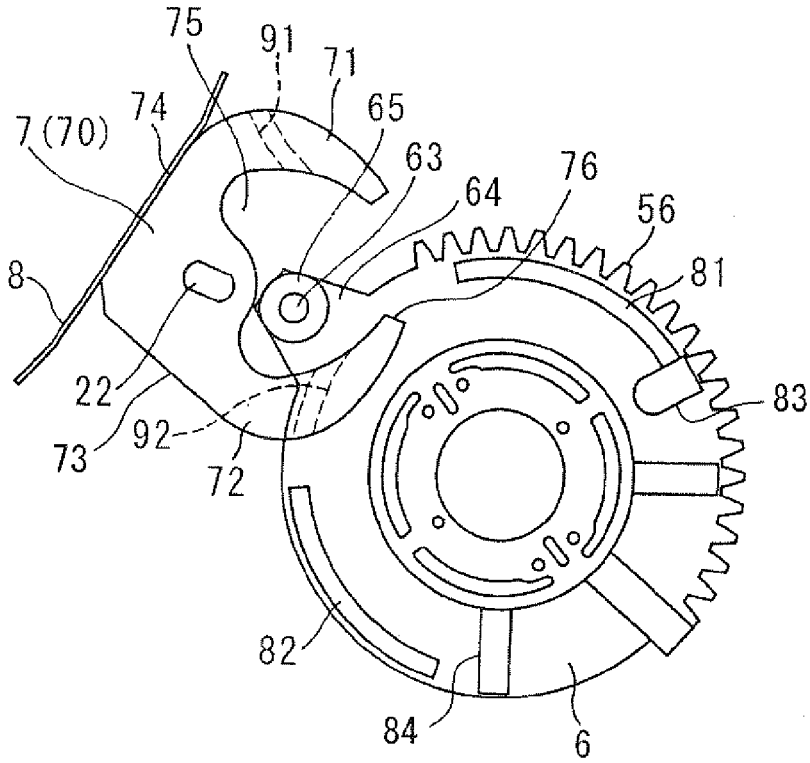
FIG. 11 is a descriptive view showing the intermediate positional state at the time of executing the mode change operation according to the first embodiment.

Next, the operation of the EGR valve module installed in the EGR system of the present embodiment will be described with reference to FIGS. 1 to 13. FIGS. 7 to 9 indicate the hot mode side lock state, and FIGS. 10 and 11 indicate the intermediate position during the mode change operation. Furthermore, FIGS. 12 and 13 indicate the cooled mode side lock state.

At the time of changing the mode change valve 4 from the cooled mode to the hot mode, the ECU first computes a control target value (target valve opening degree), which is set based on the operational state of the engine. Then, the ECU supplies the electric power to the electric motor 5 and thereby rotates the output shaft of the electric motor 5 in the hot mode side valve opening direction. In this way, the drive torque of the electric motor 5 is transmitted to the motor gear 51, the intermediate speed reducing gear 52 and the rotary gear 6. Thereby, the rotary gear 6 is rotated about the rotational axis thereof.

Thus, the first shaft 21, to which the drive torque of the electric motor 5 is transmitted from the rotary gear 6, is rotated for a predetermined angle in the hot mode side valve opening direction upon the rotation of the rotary gear 6.

At this time, the roller 65, which is rotatably supported by the arm pin 63 provided in the rotary gear 6, revolves about the rotational axis of the rotary gear 6 and rotates about the center axis of the arm pin 63 during the revolving movement of the roller 65.

The rotation of the rotary gear 6 starts from the link position (engaging position), at which the roller 65 of the rotary gear 6 is linked with the cam profile of the cam recess D of the rotary cam 7. At this time, the rotational angle θ of the EGR valve 3 is zero degrees (i.e., θ=0 degrees), and thereby the operational position of the mode change valve 4 is in the bypass full close position. Specifically, the internal passage of the housing 1 is set to the cooled mode (100%).

Next, when the rotary gear 6 is further rotated by maintaining the supply of the electric power to the electric motor 5, the roller 65 is rolled along the cam profile of the cam protrusion C of the rotary cam 7 and pushes the cam protrusion C. Therefore, the drive torque of the electric motor 5 is transmitted from the roller 65 of the rotary gear 6 to the rotary cam 7. Thereby, the rotary cam 7 is rotated about the rotational axis thereof. At this time, the internal passage of the housing 1 is changed from the cooled mode to a hot/cooled mixing mode.

In this way, the cooled EGR gas, which is conducted through the first EGR gas passage 11, the EGR cooler 10 and the second EGR gas passage 12, is mixed with the hot EGR gas, which is conducted through the bypass passage 13, at a predetermined mixing ratio, which corresponds to the rotational angle of the mode change valve 4. Then, the mixed EGR gas is outputted from the EGR gas outlet port 34 into the intake passage. Thereby, the temperature of the EGR gas, which is recirculated from the housing 1 of the EGR valve module to the intake passage and the intake port, is adjusted to the appropriate temperature. As a result, the quantity of NOx exhausted from the engine and the quantity of HC exhausted from the engine can be simultaneously reduced. Furthermore, at the time of the hot/cooled mixing mode, regeneration of the diesel particulate filter (DPF) may be performed, if desired.

Then, the second shaft 22, to which the drive torque of the electric motor 5 is transmitted from the rotary cam 7, is rotated for a predetermined angle toward the hot mode side upon the rotation of the rotary cam 7. That is, the mode change valve 4 is rotated for the predetermined angle toward the hot mode side upon the rotation of the rotary cam 7.

When the rotary gear 6 and the rotary cam 7 are rotated up to the point where the roller 65 of the rotary gear 6 reaches the cam recess B after passing through the cam protrusion C, i.e., when the rotational angle θ of the EGR valve 3 reaches 20 degrees (i.e., θ=20 degrees), the operational position of the mode change valve 4 is changed to the bypass full open position. That is, the internal passage of the housing 1 is changed from the hot/cooled mixing mode to the hot mode (100%).

Then, when the rotary gear 6 is further rotated by maintaining the supply of the electric power to the electric motor 5, the roller 65 is driven to pass through the cam recess A and is finally removed from the slot 75 and the slot opening 76 of the rotary cam 7. Thereby, the rotary cam 7 is no longer linked to the rotary gear 6. In this way, even when the EGR valve 3 and the rotary gear 6 are further rotated in the hot mode side valve opening direction, the rotational angle of the rotary cam 7 does not change, and thereby the mode change valve 4 is maintained in the hot mode. At this time, the guard 82 of the rotary gear 6 is engaged with the engaging groove 92 formed in the front surface of the cam arm 72 of the rotary cam 7 (the hot mode side lock state shown in FIGS. 7 to 9).

In this way, even in the unlinked state of the rotary cam 7 relative to the rotary gear 6 where the rotary cam 7 is not linked to the rotary gear 6, it is possible to limit the erroneous movements (e.g., the overturn of the mode change valve 4), more specifically, the abnormal displacement of the rotary cam 7 away from the rotary gear 6 or the deviation of the positional relationship of the roller 65 of the rotary gear 6 relative to the slot opening 76 of the rotary cam 7, which may possibly limit reestablishment of the linkage between the rotary cam 7 and the rotary gear 6, caused by the influences, such as the engine vibrations, the vehicle body vibrations or abnormal high pressure pulsations.

Thereby, the EGR valve 3 is controlled to have the valve opening degree, which corresponds to the control target value. Furthermore, the operational position of the mode change valve 4 is set to the hot mode, at which the flow quantity of the hot EGR gas is maximized. In this way, the hot EGR gas, which is the portion of the exhaust gas discharged from the combustion chamber of each corresponding cylinder of the engine, is recirculated from the exhaust passage to the intake passage of the engine through the interior (the bypass passage 13) of the EGR valve module. That is, the hot EGR gas, which is supplied into the interior of the housing 1 of the EGR valve module, is entirely recirculated into the intake passage of the engine while bypassing the EGR cooler 10. Specifically, the hot EGR gas is mixed with the intake air, which is supplied to the combustion chamber of each corresponding cylinder of the engine.

In this way, at the time of starting the engine under the cold temperature, the intake air can be sufficiently warmed up. Thereby, the combustibility of fuel at the engine is improved, and the generation of the hydrocarbon (HC) and white smoke can be limited.

Also, at the time of regeneration of the diesel particulate filter (DPF), the hot EGR gas can be guided into the intake passage. Therefore, the temperature of the intake air supplied into the combustion chamber is increased, and thereby the temperature of the exhaust gas supplied to the DPF can be advantageously increased. In this way, the temperature of the DPF can be increased by supplying the hot exhaust gas to the DPF to achieve the combustion temperature (e.g., 500 to 650 degrees Celsius) of the particulates (PM). Thereby, the regeneration of the DPF can be implemented with the low fuel consumption, and the emissions can be further reduced because of the regeneration of the DPF.

Next, when the mode of the mode change valve 4 is changed from the hot mode to the cooled mode, the EGR valve 3 is driven from the current position to the valve full close position (i.e., $\theta=0$ degrees) and is further driven from the valve full close position ($\theta=0$ degrees) to the cooled mode side valve opening direction.

At this time, the rotary cam 7 is not linked to the rotary gear 6 until the EGR valve 3 and the rotary gear 6 are rotated to the position at which the roller 65 of the rotary gear 6 is linked (engaged) with the cam recess B of the rotary cam 7. Therefore, before the linking of the roller 65 of the rotary gear 6 to the cam recess B of the rotary cam 7, even when the EGR valve 3 and the rotary gear 6 are rotated in the valve closing direction, the rotational angle of the rotary cam 7 does not change, and thereby the mode change valve 4 is maintained in the hot mode.

When the rotary gear 6 is further rotated by maintaining the supply of the electric power to the electric motor 5, the roller 65 reaches the link position (engaging position), at which the roller 65 of the rotary gear 6 is linked with the cam profile of the cam recess B of the rotary cam 7. At this time, the rotational angle $\theta$ of the EGR valve 3 is $-10$ degrees (i.e., $\theta=-10$ degrees), and thereby the operational position of the mode change valve 4 is in the bypass full open position. Specifically, the internal passage of the housing 1 is set to the hot mode (100%).

Next, when the rotary gear 6 is further rotated by maintaining the supply of the electric power to the electric motor 5, the roller 65 is rolled along the cam profile of the cam protrusion C of the rotary cam 7 and pushes the cam protrusion C. Therefore, the drive torque of the electric motor 5 is transmitted from the roller 65 of the rotary gear 6 to the rotary cam 7. Thereby, the rotary cam 7 is rotated about the rotational axis thereof. At this time, the internal passage of the housing 1 is changed from the hot mode to the hot/cooled mixing mode.

In this way, the cooled EGR gas, which is conducted through the first EGR gas passage 11, the EGR cooler 10 and the second EGR gas passage 12, is mixed with the hot EGR gas, which is conducted through the bypass passage 13, at a predetermined mixing ratio, which corresponds to the rotational angle of the mode change valve 4. Then, the mixed EGR gas is outputted from the EGR gas outlet port 34 into the intake passage. Thereby, the temperature of the EGR gas, which is recirculated from the housing 1 of the EGR valve module to the intake passage and the intake port, is adjusted to the appropriate temperature. As a result, the quantity of NOx exhausted from the engine and the quantity of HC exhausted from the engine can be simultaneously reduced. Furthermore, at the time of the hot/cooled mixing mode, the regeneration of the DPF may be performed, if desired.

Then, the second shaft 22, to which the drive torque of the electric motor 5 is transmitted from the rotary cam 7, is rotated for a predetermined angle toward the cooled mode side upon the rotation of the rotary cam 7. That is, the mode change valve 4 is rotated for the predetermined angle toward the cooled mode side upon the rotation of the rotary cam 7.

When the rotary gear 6 and the rotary cam 7 are rotated up to the point where the roller 65 of the rotary gear 6 is linked to the cam recess D, i.e., when the rotational angle $\theta$ of the EGR valve 3 reaches $-30$ degrees (i.e., $\theta=-30$ degrees), the operational position of the mode change valve 4 is changed to the bypass full close position. That is, the internal passage of the housing 1 is changed from the hot/cooled mixing mode to the cooled mode (100%).

Then, when the rotary gear 6 is further rotated by maintaining the supply of the electric power to the electric motor 5, the roller 65 is driven to pass through the cam recess E and is finally removed from the slot 75 and the slot opening 76 of the rotary cam 7. Thereby, the rotary cam 7 is no longer linked to the rotary gear 6. In this way, even when the EGR valve 3 and the rotary gear 6 are further rotated in the cooled mode side valve opening direction, the rotational angle of the rotary cam 7 does not change, and thereby the mode change valve 4 is maintained in the cooled mode. At this time, the guard 81 of the rotary gear 6 is engaged with the engaging groove 91 formed in the front surface of the cam arm 71 of the rotary cam 7 (the cooled mode side lock state shown in FIGS. 12 and 13).

In this way, even in the unlinked state of the rotary cam 7 relative to the rotary gear 6, it is possible to limit the erroneous movements (e.g., the overturn of the mode change valve 4), more specifically, the abnormal displacement of the rotary cam 7 away from the rotary gear 6 or the deviation of the positional relationship of the roller 65 of the rotary gear 6 relative to the slot opening 76 of the rotary cam 7, which may possibly limit reestablishment of the linkage between the rotary cam 7 and the rotary gear 6, caused by the influences, such as the engine vibrations, the vehicle body vibrations or abnormal high pressure pulsations.

As discussed above, when the operational position of the mode change valve 4 is changed to the bypass full close position, the internal passage of the housing 1 is set to the cooled mode. In the cooled mode, the EGR gas is recirculated into the intake passage through the first EGR gas passage 11, the EGR cooler 10 and the second EGR gas passage 12.

Thereby, the operational position of the mode change valve 4 is set to the cooled mode, at which the flow quantity of the cooled EGR gas is maximized, so that the EGR gas, which is supplied into the interior of the housing 1 of the EGR valve module, is entirely recirculated into the intake passage through the EGR cooler 10.

In this way, the EGR gas, which has been sufficiently cooled at the time of passing through the interior of the EGR cooler 10, i.e., the EGR gas, which has the low temperature and the low density, is mixed into the intake air in the intake passage.

Thus, the combustion temperature of the engine can be advantageously reduced to reduce the amount of generation of noxious components (e.g., nitrogen oxide, i.e., NOx) contained in the exhaust gas without reducing the output power of the engine. Furthermore, the EGR gas, which is recirculated into the intake passage, is cooled in the EGR cooler 10. Thereby, the charging efficiency of the combustion chamber of the engine is improved, so that the emissions of the engine can be further reduced.

Next, when the EGR valve 3 is returned from the cooled mode side valve full open position (θ=−70 degrees) to the valve full close position (θ=0 degrees), the rotary gear 6 is rotated in the valve closing direction by supplying the electric power to the electric motor 5.

At this time, the rotary cam 7 is not linked to the rotary gear 6 until the EGR valve 3 and the rotary gear 6 are rotated to the position at which the roller 65 of the rotary gear 6 is lined (engaged) with the cam recess D of the rotary cam 7. Therefore, before the linking of the roller 65 of the rotary gear 6 to the cam recess D of the rotary cam 7, even when the EGR valve 3 and the rotary gear 6 are rotated in the valve closing direction, the rotational angle of the rotary cam 7 does not change, and thereby the mode change valve 4 is maintained in the cooled mode.

When the rotary gear 6 is further rotated by maintaining the supply of the electric power to the electric motor 5, the roller 65 reaches the link position (engaging position), at which the roller 65 of the rotary gear 6 is linked with the cam profile of the cam recess D of the rotary cam 7. When the roller 65 reaches the link position (engaging position), at which the roller 65 of the rotary gear 6 is linked with the cam profile of the cam recess D of the rotary cam 7, the supply of the electric power to the electric motor 5 is stopped. At this time, the EGR valve 3 is stopped in the valve full close position (θ=0 degrees).

The valve opening degree (rotational angle) of the EGR valve 3 is set based on the control target value (target valve opening degree), which is set in response to the operational state of the engine. Thereby, the valve opening degree (rotational angle) of the EGR valve 3 is changed (repeatedly increased and decreased) while the mode change valve 4 is maintained in the bypass full close position (cooled mode). While the mode change valve 4 is maintained in the bypass full open position (hot mode), the valve opening degree (rotational angle) of the EGR valve 3 is changed (repeating the increase and decrease of the valve opening degree of the EGR valve 3). Also, while the mode change valve 4 is set in the intermediate opening degree (intermediate position) between the bypass full close position and the bypass full open position, i.e., in the mixing position (hot/cooled mixing mode) for mixing the cooled EGR gas and the hot EGR gas, the valve opening degree (rotational angle) of the EGR valve 3 is changed (repeating the increase and decrease of the valve opening degree of the EGR valve 3) synchronously with the mode change valve 4.

Now, the advantages of the first embodiment will be described.

As discussed above, according to the present embodiment, the EGR valve module, which is installed in the EGR system, has the drive force transmitting mechanism 50, which includes the rotary gear 6, the rotary cam 7 and the spring 8. The rotary gear 6 transmits the drive torque of the electric motor 5 to the EGR valve 3 to drive the same. The rotary cam 7 transmits the drive torque of the electric motor 5 to the mode change valve 4 to drive the same. The spring 8 urges the rotary cam 7 toward the rotary gear 6. The rotary cam 7 is releasably engageable with the rotary gear 6.

in this way, the first and second valves (i.e., the EGR valve 3 and the mode change valve 4), which are separately driven by the two different actuators, respectively, and are provided for different purposes (different operational patterns), respectively, in the prior art system, are now driven by the single electric actuator 100 having the electric motor 5 and the drive force transmitting mechanism 50 according to the present embodiment.

Here, in the synchronization range, in which the EGR valve 3 and the mode change valve 4 are synchronized with each other, the mode change valve 4 and the rotary cam 7 are linked to the EGR valve 3 and the rotary gear 6. Therefore, the drive torque of the electric motor 5 is transmitted to both of the EGR valve 3 and the mode change valve 4 through the drive force transmitting mechanism 50 of the single electric actuator 100 to synchronously drive the EGR valve 3 and the mode change valve 4.

The cam profile of the cam portion 7*a* of the rotary cam 7 is constructed such that when the EGR valve 3 and the mode change valve 4 are out of the synchronization range, the cam profile of the cam portion 7*a* of the rotary cam 7 is released from the roller 65 of the rotary gear 6. That is, when the EGR valve 3 and the mode change valve 4 are out of the synchronization range, the mode change valve 4 and the rotary cam 7 are no longer linked to the EGR valve 3 and the rotary gear 6. Therefore, the drive torque of the electric motor 5 is transmitted only to the EGR valve 3 to drive the same. As a result, in comparison to the prior art EGR valve module, it is possible to reduce the number of the actuators (serving as the drive power sources) from two to one. In this way, the number of the components is reduced, so that the manufacturing costs and the product costs can be reduced. Furthermore, the entire size of the EGR valve module can be reduced, so that it is possible to reduce the required installation space in, for example, the vehicle for installing the EGR valve module. As a result, the installability of the EGR valve module to the engine room of the vehicle, particularly the installability of the EGR valve module to the engine can be improved.

Also, the single electric actuator 100, which has the electric motor 5 that can generate the lager rotational drive force (drive torque) in comparison to the negative pressure driven actuator during the low negative pressure period, is used to drive the first and second valves (the EGR valve 3 and the mode change valve 4). Therefore, even in the case where the deposit, which is accumulated and solidified around the EGR valve 3 and the mode change valve 4, causes the sticking of the EGR valve 3 and the mode change valve 4 to the passage wall surface of the housing 1, the sticking of the EGR valve 3 and the mode change valve 4 caused by the deposit can be easily released by the drive torque of the electric motor 5.

In the unlinked region, in which the roller 65 of the rotary gear 6 and the cam portion 7*a* of the rotary cam 7 are not linked with each other, the mode change valve 4 and the rotary cam 7, which are placed out of the drive force transmission path of the electric motor 5, can be displaced to the outside area where the mode change valve 4 and the rotary cam 7 do not have an influence on the operation of the EGR valve 3 and the rotary gear 6 placed in the drive force transmission path of the electric motor 5. Furthermore, the mode change valve 4 and the rotary cam 7 can be held at the location (rotational angle), which is displaced from the drive force transmission path of the electric motor 5, by the valve lock mechanism that includes the guards 81, 82, which are formed in the rear surface of the rotary gear 6, and the engaging grooves 91, 92, which are formed in the front surface of the rotary cam 7. Also, the valve lock mechanism allows easy re-establishment of the linkage between the roller 65 of the rotary gear 6 and the cam portion 7*a* of the rotary cam 7 and thereby allows the linkage between the first and second valves (the EGR valve 3 and the mode change valve 4) through use of the single actuator 100.

The supply of the electric power to the electric motor 5 is variably controlled (EGRV assembly opening closing control operation) such that the opening and closing movements of the EGR valve 3 through the valve full close position of the EGR valve 3 is executed in a predetermined angular range of the EGR valve 3 (see a cleaning mode of FIG. 5B, which is in a range of −10 degrees to +10 degrees), which includes the valve full close position (θ=0 degrees), to execute the deposit scraping operation (cleaning control operation). Thereby, it is possible to scrape, i.e., remove the deposit, which is adhered or accumulated around the EGR valve 3 (particularly, the passage wall surface of the housing 1 at or around the valve full close position of the EGR valve 3, and/or the slide portion or the seal portion between the nozzle 2 held by the nozzle fitting portion of the hosing 1 and the seal ring 35 of the EGR valve 3).

Also, as shown in FIG. 6, the cam profile of the rotary cam 7 (the recessed curved surface of the cam recess B and the recessed curved surface of the cam recess D) is constructed such that the larger torque is generated in the small rotational angular range of the mode change valve 4 and the rotary cam 7 in comparison to the large rotational angular range of the mode change valve 4 and the rotary cam 7. In this way, for example, at the time of the engine start, when the mode change operation of the mode change valve 4 from the cooled mode to the hot mode is started in the small rotational angular range of the mode change valve 4 and the rotary cam 7 (the rotational angle θ of the EGR valve 3 being 0 degrees, i.e., θ=0 degrees), the large torque can be applied to the mode change valve 4. Therefore, at least the sticking of the mode change valve 4, which is caused by the deposit accumulated and solidified around the mode change valve 4 (around the bypass full close position), can be released with the small release torque of the electric motor 5. Furthermore, at the time of the engine start, when the mode change operation of the mode change valve 4 from the hot mode to the cooled mode is started in the small rotational angular range of the mode change valve 4 and the rotary cam 7 (the rotational angle θ of the EGR valve 3 being −10 degrees, i.e., θ=−10 degrees), the large torque can be applied to the mode change valve 4. Therefore, at least the sticking of the mode change valve 4, which is caused by the deposit accumulated and solidified around the mode change valve 4 (around the bypass full open position), can be released with the small release torque of the electric motor 5.

The first and second blocks 39, which project toward the passage wall surface of the housing 1, are provided around the opposed axial end surfaces of the mode change valve 4, particularly around the second shaft 22. In place of the first and second blocks 39, there may be provided spacers, each of which is inserted between the corresponding one of the axial end surfaces of the mode change valve 4 and the passage wall surface of the housing 1 to define a predetermined gap (gap S for releasing the deposit) therebetween.

In this way, the deposit release gap S is formed between each of the opposed axial end surfaces of the mode change valve 4 and the passage wall surface of the housing 1. Therefore, the sticking of the mode change valve 4, which is caused by the deposit accumulated and solidified around the mode change valve 4, can be released with the small release torque. Furthermore, even when the mode change valve 4 sticks to the passage wall surface of the housing 1 due to the deposit, the location of the deposit is limited around the second shaft 22 of the mode change valve 4. Therefore, the required release torque, which is required to release the sticking of the mode change valve 4 caused by the deposit accumulated and solidified at least around the second shaft 22 of the mode change valve 4, is relatively small. In this way, the size of the electric actuator 100, particularly the size of the electric motor 5 can be reduced, so that the required installation space can be further reduced.

Second Embodiment

Figure 14:
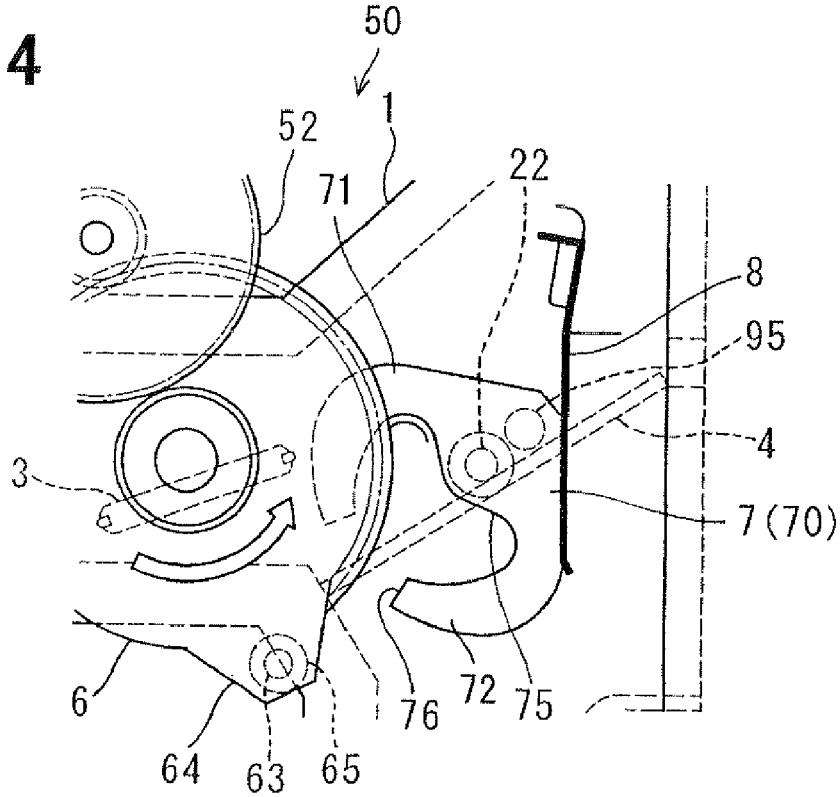
FIG. 14 is a schematic diagram showing a main feature of a drive force transmitting mechanism according to a second embodiment of the present invention.
Figure 15:
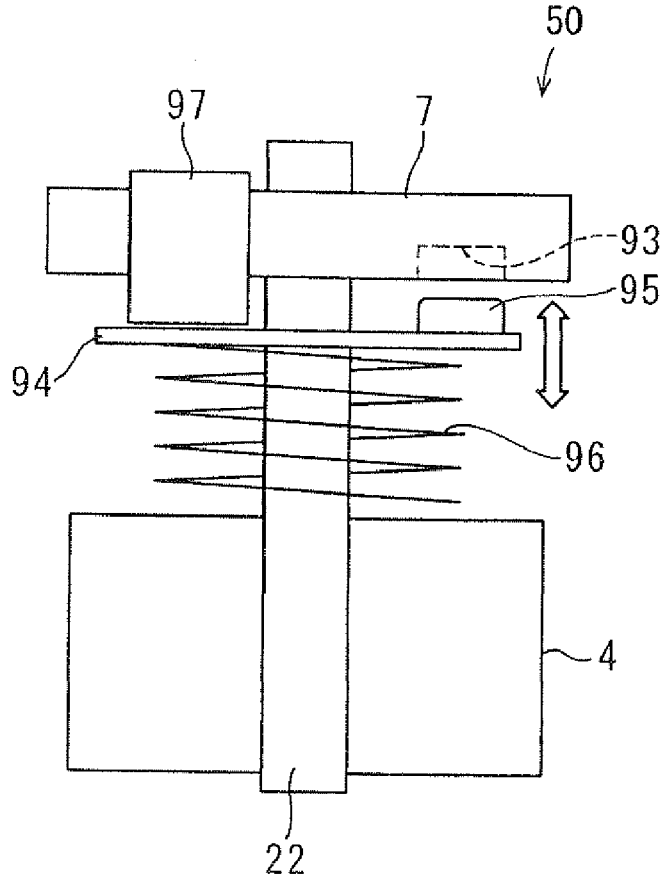
FIG. 15 is a schematic view showing a portion of the drive force transmitting mechanism around a mode change valve according to the second embodiment.

FIGS. 14 and 15 show a second embodiment of the present invention. Specifically, FIG. 14 shows a main feature of the drive force transmitting mechanism 50, and FIG. 15 shows a portion of the drive force transmitting mechanism 50 around the mode change valve 4.

The drive force transmitting mechanism 50 of the present embodiment includes a valve lock mechanism (valve limiting means), which limits the rotational movement of the mode change valve 4 and the rotary cam 7 about the rotational axis of the rotary cam 7 in the unlinked state, in which the rotary cam 7 is not linked to the rotary gear 6.

The valve lock mechanism includes a circular engaging groove 93, an engaging pin 95 and a spring 96. The engaging groove 93 is formed in the rear surface of the rotary cam 7. The engaging pin 95 is formed in the front surface of a plate 94, which is slidably fitted to an outer peripheral surface of the second shaft 22 of the mode change valve 4. The engaging pin 95 is releasably engageable into the engaging groove 93. The spring 96 exerts the urging force against the plate 94 in a direction (thrust direction) for urging the engaging pin 95 to the rear surface of the rotary cam 7.

In the case of locking the mode change valve 4 and the rotary cam 7, the engaging pin 95 is driven in the thrust direction (axial direction of the second shaft 22) to engage the engaging pin 95 into the engaging groove 93.

At the time of changing the operational mode from the cooled mode to the hot mode or at the time of changing the operational mode from the hot mode to the cooled mode, a release button 97 is pressed downward to downwardly urge the plate 94 against the urging force of the spring 96, so that the engaging pin 95 is removed from the engaging groove 93.

Now, modifications of the above embodiments will be described.

In the above embodiments, the EGRV assembly is placed on the downstream side of the EGR cooler 10 in the flow direction of the EGR gas. Alternatively, the EGRV assembly may be placed on the upstream side of the EGR cooler 10 in the flow direction of the EGR gas.

In the above embodiments, the present invention is applied to the EGR valve module that has the EGR cooler (exhaust gas cooler) 10 of the U-turn flow type, in which the EGR gas (exhaust gas) flows through the U-shaped passage. Alternatively, the present invention may be applied to an EGR valve module of a type, in which the EGR gas (exhaust gas) flows through an S-shaped passage or I-shaped passage. In such a case, an outlet tank portion of the exhaust gas cooler and the cooler outlet port 33 of the housing 1 may be connected to each other through an exhaust gas pipe, which does not have a heat exchanging function.

In the above embodiments, the housing of the EGR valve module is formed as the housing (valve housing) 1, which is connected to the exhaust gas recirculation pipe of the exhaust gas recirculation apparatus and thereby forms the part of the exhaust gas recirculation pipe. Alternatively, the housing of the EGR valve module may be formed as a housing, which forms part of the intake pipe or part of the exhaust pipe.

In the above embodiments, the cylindrical nozzle 2 is fitted into and held in the nozzle fitting portion of the housing 1, and the EGR valve 3 is received in the nozzle 2 in the openable and closable manner. Alternatively, the EGR valve 3 may be directly received in the openable and closable manner in the housing 1. In such a case, the nozzle 2 is not required, and thereby the number of components and the number of assembling steps can be reduced.

The seal ring groove (annular groove) may be eliminated from the outer peripheral surface of the EGR valve 3. Also, the seal ring may be eliminated from the outer peripheral surface of the EGR valve 3. In such a case, the seal ring is not required, and thereby the number of components and the number of assembling steps can be reduced.

According to the above embodiments, in the speed reducing gear mechanism, the first to third gears are used to reduce the rotational speed of the electric motor 5 at a predetermined speed reducing ratio in two steps and thereby to increase the rotational torque of the electric motor 5 to drive the first and second valves (the EGR valve 3 and the mode change valve 4). Alternative to the above speed reducing mechanism, there may be provided a speed reducing mechanism that uses a worm gear, which is fixed to the output shaft of the electric motor, and a helical gear, which is meshed with the worm gear and is rotated by the drive force transmitted from the worm gear.

Also, a speed reducing gear mechanism, which includes a rack and pinion mechanism (a moving direction change mechanism that converts a rotational movement to a linear movement), may be used. In the rack and pinion mechanism, a pinion gear is used as a final gear in the speed reducing gear mechanism, and rack teeth, which are meshed with the pinion gear, are provided in the valve shaft of the valve.

Furthermore, the speed reducing gear mechanism may include only two gears, i.e., first and second gears or may include four or more gears.

Furthermore, a driving-side pulley, which is provided to the output shaft of the electric motor 5, and a driven-side pulley, which is provided to the first rotary member, may be connected with each other through a belt.

In the above embodiments, the EGRV assembly opening and closing control operation (the deposit scraping operation) is executed in the hysteresis region, in which the operational mode is changed from the hot mode to the cooled mode. Alternatively, the EGRV assembly opening and closing control operation (the deposit scraping operation) may be executed upon turning off or turning on of the ignition switch. Also, the deposit scraping operation may be executed at the time of full close operation of the EGR valve 3 during the normal engine operation.

Also, the relationship between the flow quantity characteristic with respect to the rotational angle of the EGR valve 3 and the mode change characteristic with respect to the rotational angle of the EGR valve 3 is not limited to the one discussed in the above embodiments and may be freely changed. For example, the cooled to hot mode change point may be shifted from the point, at which the rotational angle θ of the EGR valve 3 is 0 degrees, to a location at the hot mode side or a location at the cooled mode side, which is displaced by a predetermined rotational angle from the point, at which the rotational angle θ of the EGR valve 3 is 0 degrees. Furthermore, the hot to cooled mode change point may be shifted from the point, at which the rotational angle θ of the EGR valve 3 is −10 degrees, to a location at the hot mode side or a location at the cooled mode side, which is displaced by a predetermined rotational angle from the point, at which the rotational angle θ of the EGR valve 3 is −10 degrees.

Here, in the state where the operational mode is changed from the cooled mode to the hot/cooled mixing mode, and thereby the mixing ratio between the cooled EGR gas and the hot EGR gas (the cooled mode 100% to the cooled mode 50% & hot mode 50% to the hot mode 100%) is adjusted, when it is demanded to decrease the valve opening degree of the EGR valve 3 from the current valve opening degree of the EGR valve 3, the rotational angle of the EGR valve 3 and the rotational angle of the mode change valve 4 may be changed to change the current mixing ratio to the mixing ratio, in which the quantity of the cooled EGR gas is larger than the quantity of the hot EGR gas, or alternatively the internal passage of the housing 1 may be returned from the hot/cooled mixing mode to the cooled mode. That is, the EGR valve 3 and the mode change valve 4 may be returned from the large rotational angular range thereof to the small rotational angular range thereof.

Furthermore, in the state where the operational mode is changed from the hot mode to the hot/cooled mixing mode, and thereby the mixing ratio between the cooled EGR gas and the hot EGR gas (the hot mode 100% to the cooled mode 50% & hot mode 50% to the cooled mode 100%) is adjusted, when it is demanded to decrease the valve opening degree of the EGR valve 3 from the current valve opening degree of the EGR valve 3, the rotational angle of the EGR valve 3 and the rotational angle of the mode change valve 4 may be changed to change the current mixing ratio to the mixing ratio, in which the quantity of the hot EGR gas is larger than the quantity of the cooled EGR gas, or alternatively the internal passage of the housing 1 may be returned from the hot/cooled mixing mode to the hot mode. That is, the EGR valve 3 and the mode change valve 4 may be returned from the large rotational angular range thereof to the small rotational angular range thereof.

Additional advantages and modifications will readily occur to those skilled in the art. The invention in its broader terms is therefore not limited to the specific details, representative apparatus, and illustrative examples shown and described.

What is claimed is:

1. An exhaust gas recirculation system for an internal combustion engine, comprising:

a housing that has an interior passage space, through which exhaust gas of the internal combustion engine is recirculated from an exhaust passage to an intake passage of the internal combustion engine, wherein the housing is adapted to join with an exhaust gas cooler that is communicatable with the exhaust passage and the intake passage through the interior passage space of the housing;

first and second valves, each of which is received in the housing in a manner that enables opening and closing thereof; and an actuator that includes an electric motor, wherein when the electric motor receives an electric power, the electric motor generates a drive force, which drives the first and second valves, wherein:

the first valve forms a flow quantity control valve that controls a flow quantity of the exhaust gas, which passes through the interior passage space of the housing;

the second valve forms a mode change vale that changes an operational mode of the exhaust gas recirculation system between:

a cooler mode, in which first and second gas passages are formed with aid of the second valve in the interior passage space of the housing, wherein the first gas passage is configured to communicate with an inlet of the exhaust gas cooler and thereby to conduct the exhaust gas supplied from the exhaust passage to the inlet of the exhaust gas cooler, and the second gas passage is configured to communicate with an outlet of the exhaust gas cooler and thereby to conduct the exhaust gas cooled through the exhaust gas cooler; and a bypass mode, in which a bypass passage is formed with aid of the second valve in the interior passage space of the housing, wherein the bypass passage conducts the exhaust gas supplied from the exhaust passage toward the intake passage while bypassing the exhaust gas cooler;

the actuator further includes a drive force transmitting mechanism that has:

a first rotary member, which transmits the drive force of the electric motor to the first valve to drive the first valve; and a second rotary member, which transmits the drive force of the electric motor to the second valve to drive the second valve, wherein the second rotary member is releasably linkable to the first rotary member to receive the drive force of the electric motor through the first rotary member;

the first rotary member includes an engaging element that is rotatable about a rotational axis thereof;

the second rotary member includes a cam portion that is engageable with the engaging element of the first rotary member through a predetermined synchronization range, in which movement of the first valve and movement of the second valve are synchronized with each other; and the cam portion of the second rotary member is disengaged from the engaging element of the first rotary member when the first valve and the second valve are out of the predetermined synchronization range.

2. The exhaust gas recirculation system according to claim 1, wherein each of two opposed axial end surfaces of the second valve is opposed to an interior wall surface of the housing while a predetermined gap is defined between the axial end surface of the second valve and the interior wall surface of the housing.

3. The exhaust gas recirculation system according to claim 1, wherein the engaging element is a roller, which is releasably engageable with the cam portion.

4. The exhaust gas recirculation system according to claim 3, wherein the roller is provided in an outer projecting portion of the first rotary member, which radially outwardly projects from a rest of the first rotary member.

5. The exhaust gas recirculation system according to claim 1, wherein the cam portion has a cam face, which is configured to correspond with a mode change characteristic of the second valve with respect to a rotational angle of the first rotary member.

6. The exhaust gas recirculation system according to claim 1, wherein the cam portion is configured such that a torque, which is exerted by the engaging element of the first rotary member at the cam portion of the second rotary member at a time of placing one of the second valve and the second rotary member in a small rotational angular range, is larger than a torque, which is exerted by the engaging element of the first rotary member at the cam portion of the second rotary member at a time of placing the one of the second valve and the second rotary member in a large rotational angular range that is larger than the small rotational angular range.

7. The exhaust gas recirculation system according to claim 1, wherein the cam portion has a cam face that is configured to have an area, at which a change in a rotational angle of the second valve in response to a change in a rotational angle of the first rotary member is larger than that of another area of the cam face in a linked state of the second rotary member relative to the first rotary member.

8. The exhaust gas recirculation system according to claim 1, wherein the cam portion has a cam face that is configured to have an insensitive area, at which a change in a rotational angle of the second valve in response to a change in a rotational angle of the first rotary member is small or substantially zero in a linked state of the second rotary member relative to the first rotary member.

9. The exhaust gas recirculation system according to claim 1, further comprising a valve limiting means for limiting rotation of the second rotary member about a rotational axis of the second rotary member in an unlinked state of the second rotary member relative to the first rotary member.

* * * * *